US007358935B2

(12) United States Patent
Yamashita et al.

(10) Patent No.: US 7,358,935 B2
(45) Date of Patent: Apr. 15, 2008

(54) DISPLAY DEVICE OF DIGITAL DRIVE TYPE

(75) Inventors: Atsuhiro Yamashita, Osaka (JP); Haruhiko Murata, Osaka (JP); Yukio Mori, Osaka (JP); Masutaka Inoue, Osaka (JP); Shigeo Kinoshita, Osaka (JP); Susumu Tanase, Osaka (JP)

(73) Assignee: Sanyo Electric Co., Ltd., Osaka (JP)

( * ) Notice: Subject to any disclaimer, the term of this patent is extended or adjusted under 35 U.S.C. 154(b) by 490 days.

(21) Appl. No.: 10/498,527

(22) PCT Filed: Dec. 9, 2002

(86) PCT No.: PCT/JP02/12876

§ 371 (c)(1),
(2), (4) Date: Jan. 4, 2005

(87) PCT Pub. No.: WO03/052728

PCT Pub. Date: Jun. 26, 2003

(65) Prior Publication Data

US 2005/0156828 A1 Jul. 21, 2005

(30) Foreign Application Priority Data

Dec. 14, 2001 (JP) ..... 2001-381240
Mar. 29, 2002 (JP) ..... 2002-095425

(51) Int. Cl.
*G09G 3/30* (2006.01)

(52) U.S. Cl. ..... 345/76; 345/78; 345/79; 345/82; 345/87; 345/90; 345/91; 345/92

(58) Field of Classification Search ..... 345/76, 345/78, 79, 82, 87, 90, 91, 92
See application file for complete search history.

(56) References Cited

U.S. PATENT DOCUMENTS 4,942,458 A 7/1990 Miyajima et al.
5,170,155 A 12/1992 Plus et al.
5,302,966 A 4/1994 Stewart
6,329,974 B1 12/2001 Walker et al.

(Continued)

FOREIGN PATENT DOCUMENTS

JP 60-73581 4/1985

(Continued)

*Primary Examiner*—Richard Jherpe
*Assistant Examiner*—Leonid Shapiro
(74) *Attorney, Agent, or Firm*—McDermott Will & Emery LLP

(57) ABSTRACT

The invention provides an organic LED display device of the digital drive type which has a display panel comprising a plurality of pixels 51. Each of the pixels 51 comprises an organic EL element 50, a drive transistor TR2 for effecting or interrupting the passage of current through the EL element 50 in response to the input of an on/off control signal, a write transistor TR1 to be brought into conduction upon receiving scanning voltage applied thereto from a scanning driver, a capacitance element C to be supplied with data voltage from a data driver by the write transistor TR1 conducting, and a comparator 9 for comparing a predetermined ramp voltage with the output voltage of the capacitance element C and supplying the result of comparison to the drive transistor TR2 as the on/off control signal.

28 Claims, 21 Drawing Sheets

U.S. PATENT DOCUMENTS

| | | | | |
|---|---|---|---|---|
| 6,697,037 | B1 * | 2/2004 | Alt et al. | 345/93 |
| 6,753,834 | B2 * | 6/2004 | Mikami et al. | 345/76 |
| 2002/0021267 | A1 | 2/2002 | Walker et al. | |

FOREIGN PATENT DOCUMENTS

| | | |
|---|---|---|
| JP | 2-55280 | 4/1990 |
| JP | 5-503175 | 12/1992 |
| JP | 5-328269 | 12/1993 |
| JP | 9-243994 | 9/1997 |
| JP | 11-237606 | 8/1999 |
| JP | 2000-235370 | 8/2000 |
| JP | 2001-22315 | 1/2001 |
| JP | 2002-297097 | 10/2002 |
| WO | WO 00/19401 | 4/2000 |
| WO | WO 02/27700 A2 | 4/2002 |

* cited by examiner

DISPLAY DEVICE OF DIGITAL DRIVE TYPE

TECHNICAL FIELD

The present invention relates to display devices, such as organic LED display devices, which have a display panel comprising a plurality of pixels arranged in the form of a matrix.

BACKGROUND ART

Progress has been made in developing organic electroluminescence displays (hereinafter referred to as "organic LED displays") in recent years. Use of organic LED displays, for example, in portable telephones is under study.

FIGS. 33 and 34 show an organic LED display 1, which is fabricated by forming an organic hole transport layer 15 and an organic electron transport layer 16 on opposite sides of an organic luminescent layer 14 to provide an organic layer 13 on a glass substrate 11, and forming anodes 12 and cathodes 17 on opposite sides of the organic layer 13. The organic luminescent layer 14 is caused to luminesce by applying a predetermined voltage across the anode 12 and the cathode 17.

The anodes 12 are made from transparent ITO (indium tin oxide), and the cathodes 17, for example, from an Al—Li alloy. The electrodes of each type are prepared in the form of stripes to intersect those of the other type in the form of a matrix. The anodes 12 are used as data electrodes, and the cathodes 17 as scanning electrodes. With one of horizontally extending scanning electrodes selected, voltage in accordance with input data is applied to data electrodes extending perpendicular to the scanning electrode, whereby the organic layer 13 is caused to luminesce at the intersections of the scanning electrode and the data electrodes to give a display of one line. The scanning electrodes are changed over one after anther in the perpendicular direction to scan the matrix in the perpendicular direction to give a display of one frame.

The methods of driving such organic LED displays include the passive matrix driving method wherein the scanning electrodes and the data electrodes are used for time division driving, and the active matrix driving method wherein each pixel is held luminescent for one vertical scanning period. The organic LED display of the active matrix drive type will be described with reference to FIG. 4. Each pixel 52 is provided with an organic EL element 50 comprising a portion of organic layer, a drive transistor TR2 for controlling the passage of current through the EL element 50, a write transistor TR1 which is brought into conduction in response to the application of scanning voltage SCAN by a scanning electrode and a capacitance element C in which charge is stored by the application of data voltage DATA from a data electrode when the write transistor TR1 is in conduction. The capacitance element C applies an output voltage to the gate of the drive transistor TR2.

First, voltage is applied to the scanning electrodes one after another, and a plurality of first transistors TR1 connected to the same scanning electrode are brought into conduction. Data voltage (input signal) is applied to each data electrode as timed with this scanning. Since the first transistor TR1 is in conduction, the data voltage is stored in the capacitance element C.

The operating state of the second transistor TR2 depends on the amount of charge of data voltage stored in the capacitance element C. For example when the second transistor TR2 conducts, current of a magnitude corresponding to the data voltage is supplied to the EL element 50 via the transistor TR2. Consequently, the EL element 50 luminesces with a brightness in accordance with the data voltage. This luminescent state is maintained over one vertical scanning period.

With the organic LED display of the analog drive type, current of a magnitude corresponding to the data voltage is supplied to the EL element 50 to turn on the EL element 50 with a brightness corresponding to the data voltage as described above. On the other hand, organic LED displays of the digital drive type have been proposed in which a multi-level gradation is produced by supplying to an organic EL element 50 a pulse current having a duty ratio in accordance with the data voltage (e.g., JP-A No. 312173/1998).

With organic LED displays of the digital drive type, one field (or one frame) which is the display cycle of one frame is divided into a plurality of (N) subfields (or subframes) SF, and each subfield SF comprises a scanning period and a luminescence period. The scanning periods included in one field all have the same length, but the luminescence periods have varying lengths each equal to nth power of 2 (n=0, 1, 2, . . . N−1). In the illustrated case (N=4), the four luminescence periods have respective lengths of 8, 4, 2, 1, and on-off control of luminescence period realizes expression of a 16-level gradation.

In subfield driving described, scanning voltage is applied to a write transistor TR1 providing each pixel 53 as shown in FIG. 5, within the scanning period in each subfield SF to write binary data to a capacitance element C, and a drive transistor TR2 supplies current corresponding to the binary data to an organic EL element 50 during the subsequent luminescence period. In subfield driving, the line for supplying current to the drive transistor TR2 constituting each pixel 53 is provided with an on/off switch SW as shown in FIG. 5, whereby the EL elements 50 of the pixels can be made simultaneous with respect to the same luminescence starting time and luminescence termination time in the subfield.

With the organic LED display using the subfield driving method described, all horizontal scanning lines of each of the subfields within one field must be scanned, hence the problem of necessitating high-speed scanning for a multi-level gradation or the problem of producing quasi-contours.

Accordingly, an object of the present invention is to provide a display device of the digital drive type which does not require high-speed scanning for producing a multi-level gradation and which will not permit generation of quasi-contours.

DISCLOSURE OF THE INVENTION

The present invention provides a display device of the digital drive type which comprises a display panel comprising a plurality of pixels arranged in the form of a matrix, and a scanning driver and a data driver which are connected to the display panel. Each of the pixels of the display panel comprises:

- a display element operable to luminesce when supplied with current or voltage,
- a write element to be brought into conduction with scanning voltage applied thereto by the scanning driver,
- voltage holding means for holding therein data voltage applied thereto by the data driver by the write element conducting, and drive means for supplying current or voltage to the display element only for a period of time corresponding to the magnitude of the voltage held in the voltage holding means.

Stated more specifically, the drive means compares ramp voltage having a predetermined variation curve with the output voltage of the voltage holding means and supplies current or voltage to the display element in accordance with the result of comparison. For example, the drive means can be provided by:

a drive element for effecting or interrupting passage of current through the display element in response to the input of an on/off control signal, and a comparison element for comparing ramp voltage having a predetermined variation curve with the output voltage of the voltage holding means and supplying an output signal representing the result of comparison to the drive element as the on/off control signal.

With the display device of the digital drive type of the invention, the scanning driver applies scanning voltage to the write element constituting each pixel during a scanning period within the display cycle of one frame to bring the write element into conduction, whereby data voltage is applied by the data driver to the voltage holding means for this means to hold the voltage.

During a luminescence period within the display cycle of one frame, on the other hand, ramp voltage having a predetermined variation curve is applied to the comparison element, which compares the ramp voltage with the output voltage (data voltage) of the voltage holding means. The ramp voltage varies with the predetermined variation curve, so that the magnitude relationship between the ramp voltage and the data voltage becomes reversed at a time point corresponding to the magnitude of the data voltage. Consequently, the output signal of the comparison element is given one of a high value and a low value only for a period corresponding to the data voltage. Thus, the data voltage is subjected to pulse width modulation to prepare an on/off control signal for the drive element. The drive element is on/off-controlled with this control signal to effect or interrupt the passage of current through the display element.

Stated specifically, the display element is an organic EL element, and one scanning period and one luminescence period are provided within one display cycle of one frame. The scanning voltage is applied to the write element of each pixel by the scanning driver during the scanning period for the voltage holding means of the pixel to hold the data voltage, and the ramp voltage is compared with the output voltage of the voltage holding means by the comparison element during the luminescence period to on/off-control the display element of the pixel.

Stated specifically, the ramp voltage is variable between a first value permitting the output signal of the comparison element to turn on the drive element at all times despite the data voltage and a second value permitting the output signal of the comparison element to turn off the drive element at all times despite the data voltage, and within the display cycle of one frame, retains the second value during the scanning period and varies between the first value and the second value during the luminescence period other than the scanning period. Accordingly, the drive element is off during the scanning period, holding the organic EL element unenergized at all times. Within the luminescence period other than the scanning period, the drive element is on only for a period corresponding to the data voltage, energizing the EL element.

For example, the ramp voltage has a variation curve gradually increasing or decreasing between the first value and the second value. In the case where the curve is straight, the organic EL element can be caused to luminesce only for a period of time in proportion to the magnitude of the data voltage. When the variation curve is a desired curve, the luminescence time of the organic EL element is adjustable as desired relative to the magnitude of the data voltage. For example, if a variation curve is used which involves consideration to gamma correction, required gamma correction can be made without additionally providing a gamma correction circuit.

Further if the ramp voltage has a variation curve varying from one of the first value and the second value to the other value and then returning to said one value, the organic EL element can be caused to luminesce at the midportion of the luminescence period other than the scanning period and within the display cycle of one frame.

Further it is possible to use an arrangement wherein the ramp voltage for the pixels arranged on odd-numbered lines included in horizontal or vertical lines constituting one frame has a variation curve varying from one of the first value and the second value to the other value, and the ramp voltage for the pixels arranged on even-numbered lines included in the horizontal or vertical lines has a variation curve varying from said other value to said one value. With this arrangement, the period for which the organic EL elements of the pixels on the odd-numbered lines luminesce and the period for which the organic EL elements of the pixels on the even-numbered lines luminesce can be shifted from each other to thereby disperse, with respect to time, the total quantity of current to be passed through the organic EL elements constituting one frame.

It is further possible to use an arrangement wherein the ramp voltage for the pixels arranged on lines of one of three primary colors included in horizontal or vertical lines constituting one frame has a variation curve varying from one of the first value and the second value to the other value, and the ramp voltage for the pixels arranged on lines provided for the other two colors and included in the horizontal or vertical lines has a variation curve varying from said other value to said one value. With this arrangement, the period during which the organic EL elements of the pixels on the lines of one color luminesce and the period during which the organic EL elements of the pixels on the lines for the other two colors luminesce can be shifted from each other to thereby disperse, with respect to time, the total quantity of current to be passed through the organic EL elements constituting one frame.

It is further possible to use an arrangement wherein the pixels arranged on odd-numbered lines included in horizontal or vertical lines constituting one frame and the pixels arranged on even-numbered lines included in the horizontal or vertical lines are alternately reversed in the order of the scanning period and the luminescence period within the display cycle of one frame. With this arrangement, the period during which the organic EL elements of the pixels on the odd-numbered lines luminesce and the period during which the organic EL elements of the pixels on the even-numbered lines luminesce are shifted toward the first half and the second half of the display cycle of one frame. This serves to disperse, with respect to time, the total quantity of current to be passed through the organic EL elements constituting one frame.

It is further possible to use an arrangement wherein the ramp voltage for the pixels arranged on lines of three primary colors included in horizontal or vertical lines constituting one frame differs from color to color in the variation rate (slope). With this arrangement, the proportion of the luminescence period for the pixels on the lines of three primary colors can be altered from color to color relative to the data voltage. White balance is then adjustable.

With the display device of the digital drive type according to the present invention described, a multi-level gradation can be realized by scanning all the horizontal scan lines within the display cycle of one frame only once. This obviates the necessity of resorting to high speed scanning, further eliminating the likelihood of producing quasi-contours.

BEST MODE OF CARRYING OUT THE INVENTION

Figure 1:
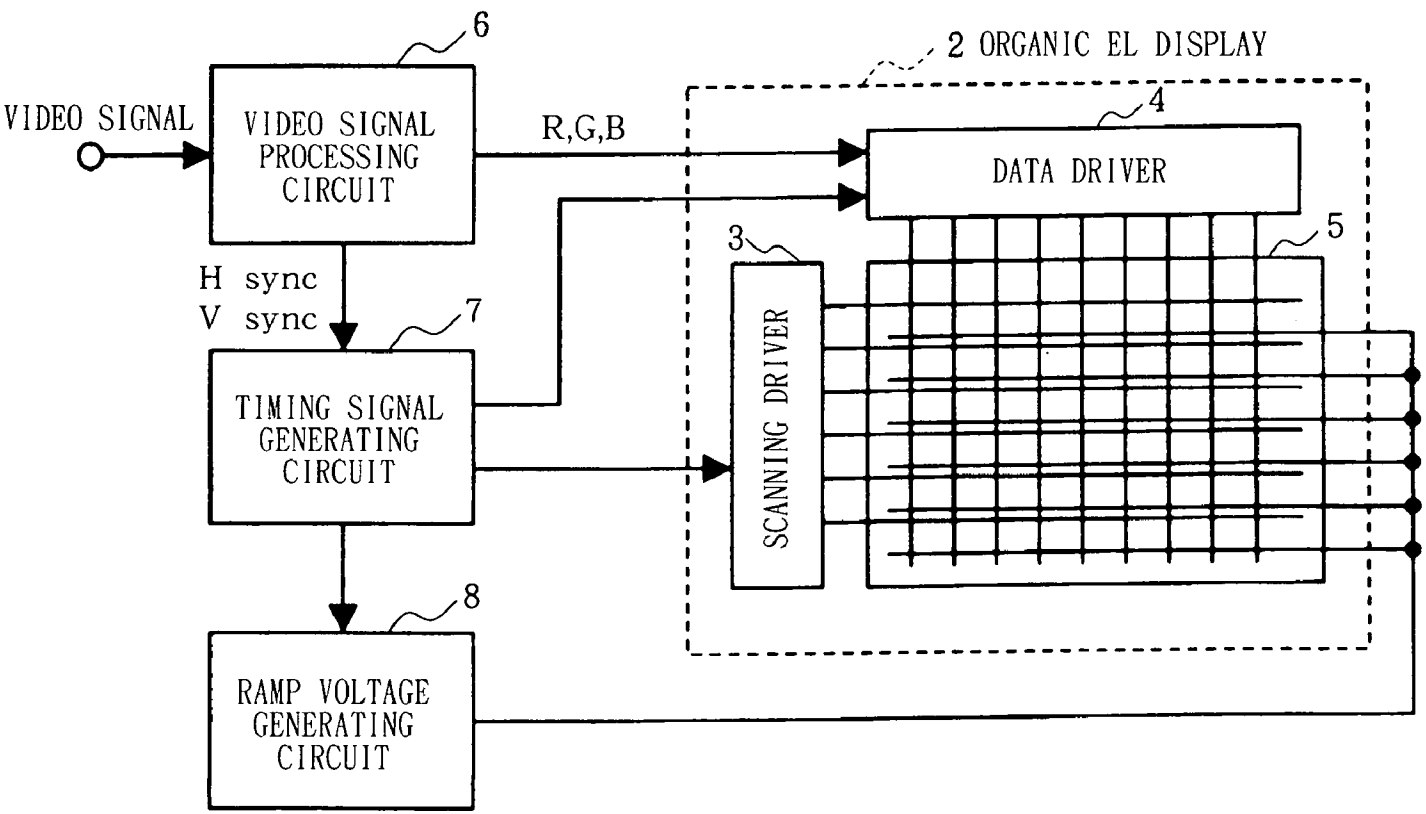
FIG. 1 is a block diagram showing the construction of an organic LED display device embodying the invention.

The present invention as embodied into organic LED display devices will be described below in detail with reference to the drawings. FIG. 1 shows an organic LED display device of the invention, which comprises a display panel 5 provided by a plurality of pixels arranged in the form of a matrix, and a scanning driver 3 and a data driver 4 which are connected to the display panel 5. A video signal from a video source such as a TV receiver is fed to a video signal processing circuit 6 for processing the signal as required for video display, and video signals of RGB three primary colors obtained are fed to the data driver 4 of the organic LED display 2.

A horizontal synchronizing signal Hsync and a vertical synchronizing signal Vsync obtained from the video signal processing circuit 6 are fed to a timing signal generating circuit 7, whereby a timing signal is obtained, which is fed to the scanning driver 3 and the data driver 4. The timing signal obtained from the circuit 7 is fed also to a ramp voltage generating circuit 8, whereby a ramp voltage is produced for use in driving the display 2 as will be described later. The ramp voltage is supplied to pixels of the display panel 5. A power source circuit (not shown) is connected to the circuits, drivers and display shown in FIG. 1.

Figure 3:
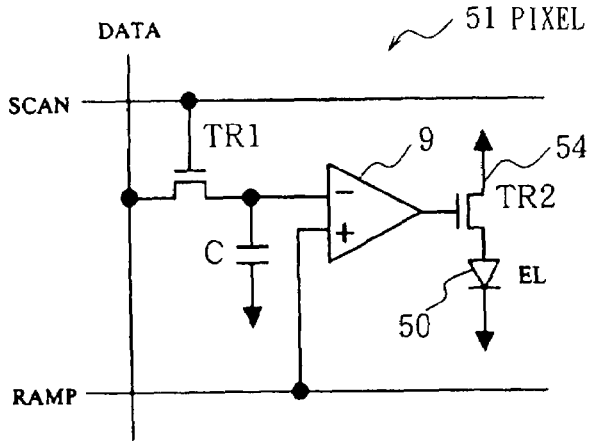
FIG. 3 is a circuit diagram of each pixel constituting the display panel of organic LED display device of the invention.
Figure 4:
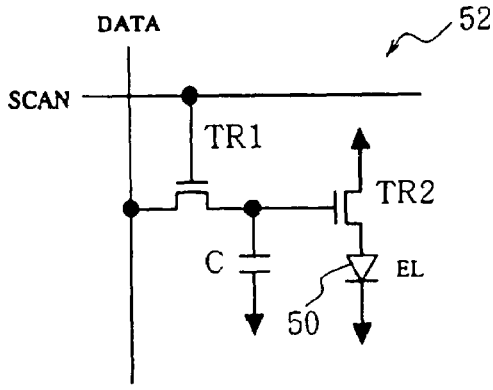
FIG.4 PRIOR ART
FIG. 4 is a circuit diagram of each pixel constituting a conventional organic LED display of the active matrix drive type.
Figure 5:
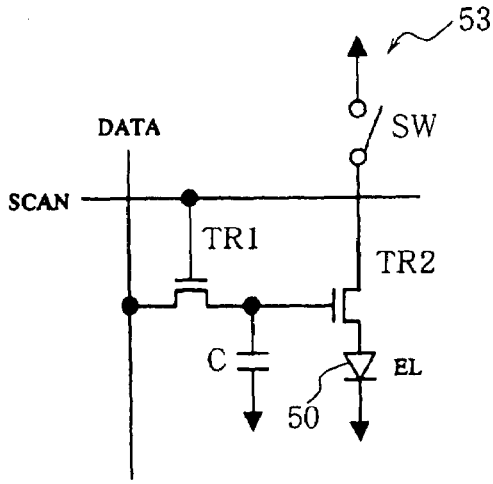
FIG. 5 is a circuit diagram of each pixel constituting an organic LED display for which a subfield driving method is used.

The display panel 5 comprises pixels 51 each having the circuit construction shown in FIG. 3 and arranged in the form of a matrix. Each pixel 51 comprises an organic EL element 50 provided by an organic layer, a drive transistor TR2 for effecting or interrupting the passage of current through the EL element 50 in response to the input of an on/off control signal to the gate, a write transistor TR1 which is brought into conduction by the application of a scanning voltage from the scanning driver to the gate, a capacitance element C to be supplied with a data voltage from the data driver by the write transistor TR1 conducting, and a comparator 9 having a pair of positive and negative input terminals to be supplied with the ramp voltage from the ramp voltage generating circuit and the output voltage of the capacitance element C for comparing the two voltages. The output voltage of the comparator 9 is fed to the gate of the drive transistor TR2.

The drive transistor TR2 has a source connected to a current supply line 54 and a drain connected to the EL element 50. The data driver is connected to one electrode (e.g., source) of the write transistor TR1, the other electrode (e.g., drain) of which has connected thereto one end of the capacitance element C and an inversion input terminal of the comparator 9. The output terminal of the ramp voltage generating circuit 8 is connected to a non-inversion input terminal of the comparator 9.

Figure 6:
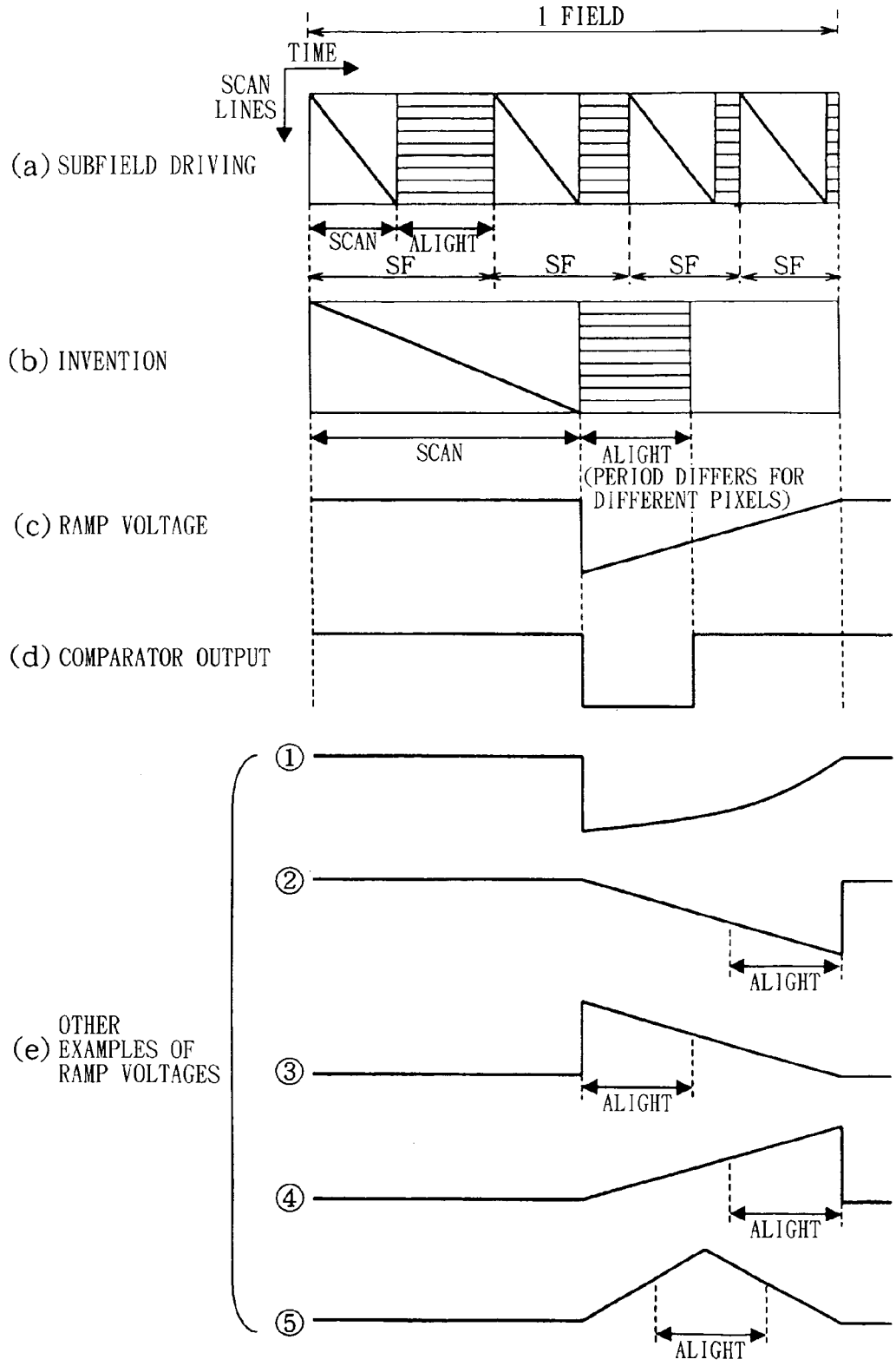
FIG. 6 is a diagram showing the timing of scanning period and luminescence period in the prior art and according to the invention, and various examples of waveforms of ramp voltages according to the invention.

With the organic LED display 2, one field period is divided into a first half scanning period and a second half luminescence period as shown in FIG. 6(*b*). During the scanning period, the scanning driver applies a scanning voltage to the write transistor TR1 constituting each pixel 51 on each horizontal line, bringing the transistor TR1 into conduction, whereby data voltage is applied to the capacitance element C by the data driver to store the voltage as a charge. As a result, data corresponding to one field is set in all the pixels constituting the LED display 2.

As shown in FIG. 6(*c*), the ramp voltage generating circuit 8 maintains a high voltage value during the first half scanning period of every field period and generates during the second half luminescence period thereof a ramp voltage linearly varying from a low voltage value to a high voltage value. During the first half scanning period, the high voltage from the ramp voltage generating circuit 8 is applied to the non-inversion input terminal of the comparator 9. This causes the comparator 9 to always deliver a high output as shown in FIG. 6(*d*) despite the input voltage to the inversion input terminal thereof.

When the circuit 8 applies the ramp voltage to the non-inversion input terminal of the comparator 9 in the second half luminescence period, the output voltage (data voltage) of the capacitance element C is simultaneously applied to the inversion input terminal of the comparator 9. This gives one of two values of high and low as shown in FIG. 6(*d*) to the output of the comparator 9 in accordance with the result of comparison of the two voltages. Stated more specifically, the output of the comparator is low while the ramp voltage is lower than the data voltage, whereas the output of the comparator is high while the ramp voltage is higher than the data voltage. The length of the period during which the comparator output is low is in proportion to the magnitude of the data voltage.

Thus, the output of the comparator 9 is low during a period proportional to the magnitude of the data voltage, whereby the drive transistor TR2 is held on only during this period, holding the EL element 50 on. Consequently, the organic EL element 50 constituting each pixel 51 providing the display panel 5 luminesces only for a period proportional to the magnitude of the data voltage for the pixels 51, within the period of one field, whereby multi-level gradation can be realized.

The organic LED display device is adapted to produce a multi-level gradation only by scanning once within one field period as described above. This eliminates the need for high speed scanning, further obviating the likelihood of producing quasi-contours. Furthermore, the organic LED display device of the invention for which the digital drive method is used is less prone to the influence of variations in the characteristics of drive transistors TR2 while realizing low power consumption due to a reduction in the power source voltage.

According to the embodiment described, the curve of variations in the ramp voltage is a straight line representing an increase but can be a desired curve so as to adjust as desired the luminescence time of the organic EL element 50 relative to the magnitude of the data voltage. For example as shown in FIG. 6(*e*), (1), required gamma correction can be made by using a variation curve involving consideration to gamma correction without using an additional gamma correction circuit.

FIG. 6(*e*), (2) shows a ramp voltage variation curve which is reversely sloped. This makes it possible to provide a luminescence period in the second half of the ramp period. Further if the two inputs to the comparator 9 are reversed in positive-negative relationship, the ramp voltage may be reversed also in positive-negative relationship as represented by FIG. 6(*e*), (3) or (4). When the ramp voltage variation curve to be used is in the form of a triangular wave extending from low to high and to low again as represented by FIG. 6(*e*), (5), the organic EL element 50 can be made to luminesce in the midportion of the ramp period.

Figure 7:
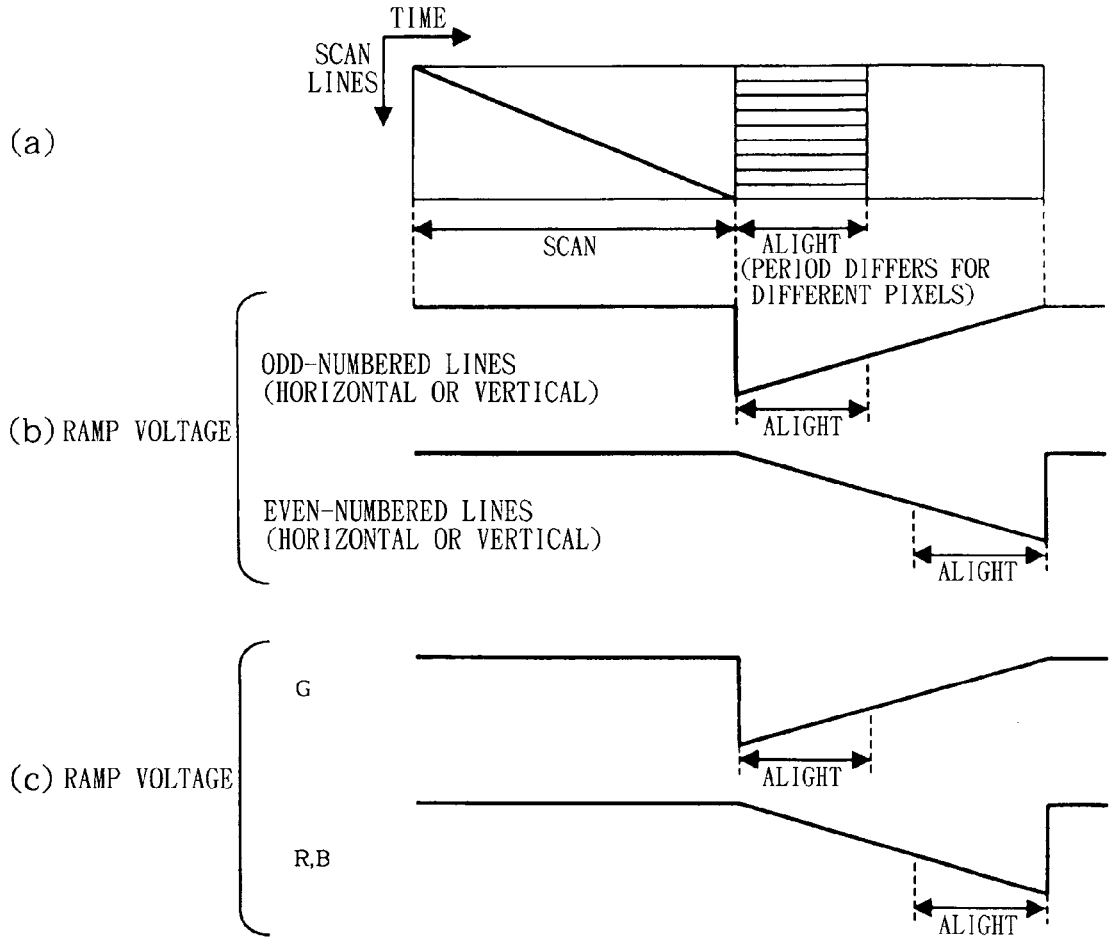
FIG. 7 is a diagram showing the timing of scanning period and luminescence period according to the invention, and other examples of waveforms of ramp voltages according to the invention.

With reference to FIG. 7(*a*), (*b*), the ramp voltage for the pixels arranged on odd-numbered lines included in the horizontal or vertical lines in one field period and the ramp voltage for the pixels arranged on even-numbered lines included in the above lines are altered along variation lines having respective variation rates which are opposite in positive-negative relationship, whereby the luminescence period of organic EL elements of the pixels on the odd-numbered lines and the luminescence period of organic EL elements of the pixels on the even-numbered lines can be shifted from each other. This makes it possible to disperse, with respect to time, the total quantity of current to be passed through the EL elements forming one providing one frame.

Further as shown in FIG. 7(*c*), the ramp voltage for the pixels arranged on the lines of one color (e.g., G) among the three primary colors of RGB and the ramp voltage for the pixels on the lines of the other two colors (e.g., R and B) are altered along variation lines having respective variation rates which are opposite in positive-negative relationship. This makes it possible to disperse, with respect to time, the total quantity of current to be passed through the EL elements providing one frame as in the above case.

Figure 8:
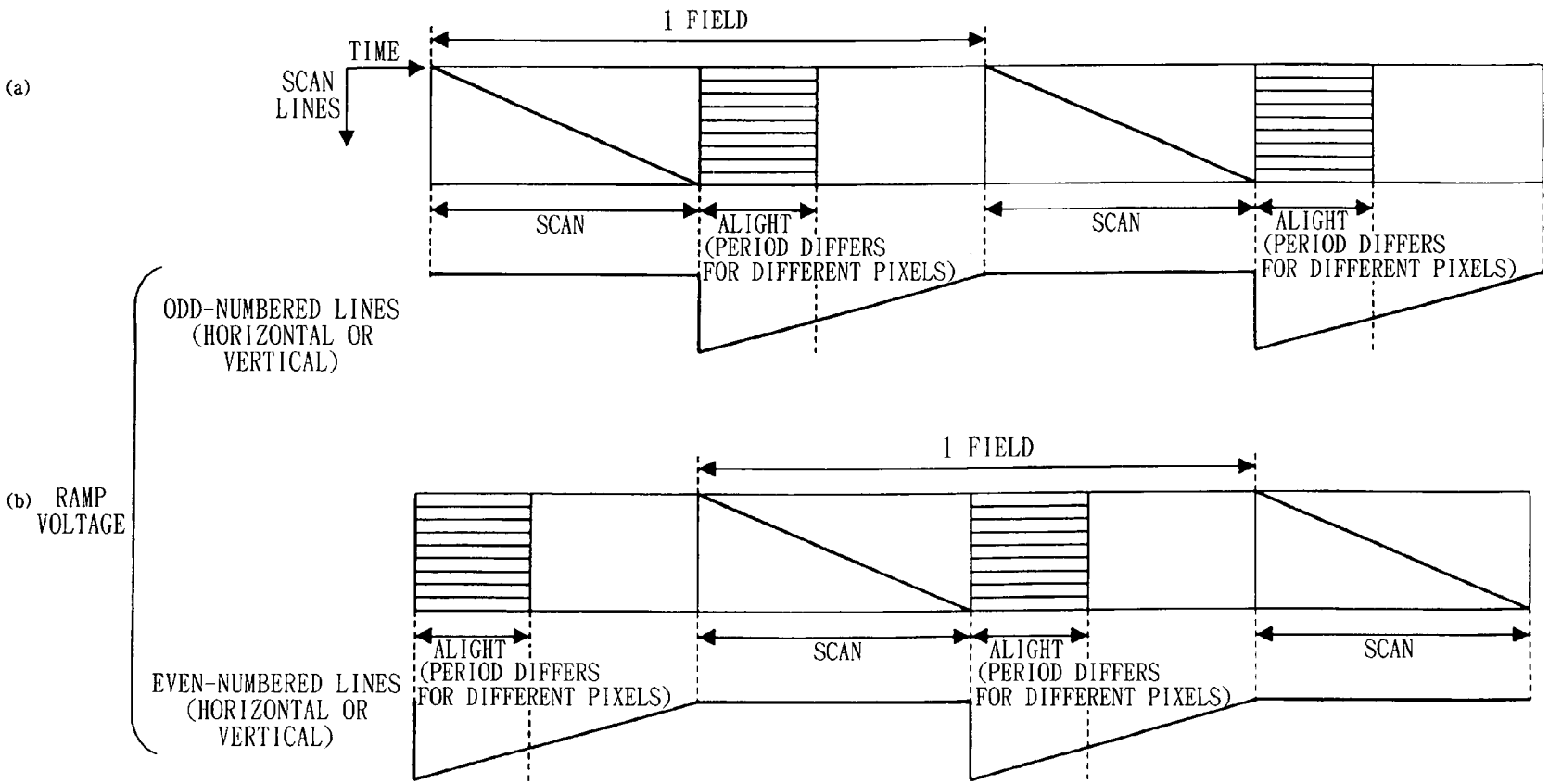
FIG. 8 is a diagram showing the timing of scanning period and luminescence period according to the invention, and other examples of waveforms of ramp voltages according to the invention.

Further as shown in FIG. 8(*a*), (*b*), one field period for the pixels arranged on the odd-numbered lines included in the horizontal or vertical lines constituting one frame and one field period for the pixels arranged on the even-numbered lines included in the above lines are shifted from each other by ½ of the cycle, whereby the luminescence period for the pixels arranged on the odd-numbered lines and the luminescence period for the pixels arranged on the even-numbered lines can be shifted from each other by ½ the cycle. This makes it possible to disperse, with respect to time, the total quantity of current to be passed through the EL elements providing one frame. The scanning speed also can then be decreased.

Figure 32:
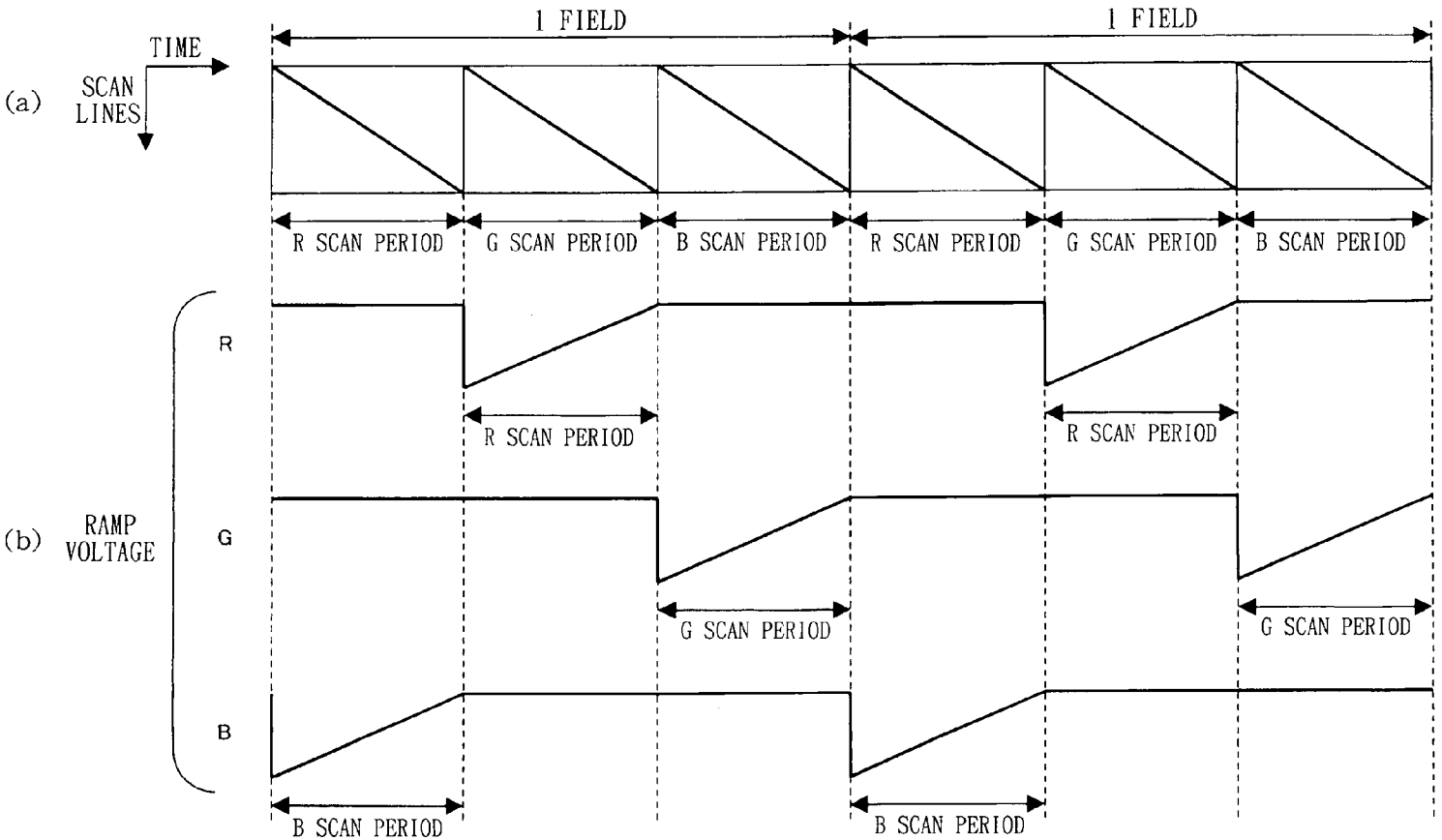
FIG. 32 is a diagram showing the timing of scanning period and luminescence period according to the invention, and other examples of waveforms of ramp voltages according to the invention.
Figure 33:
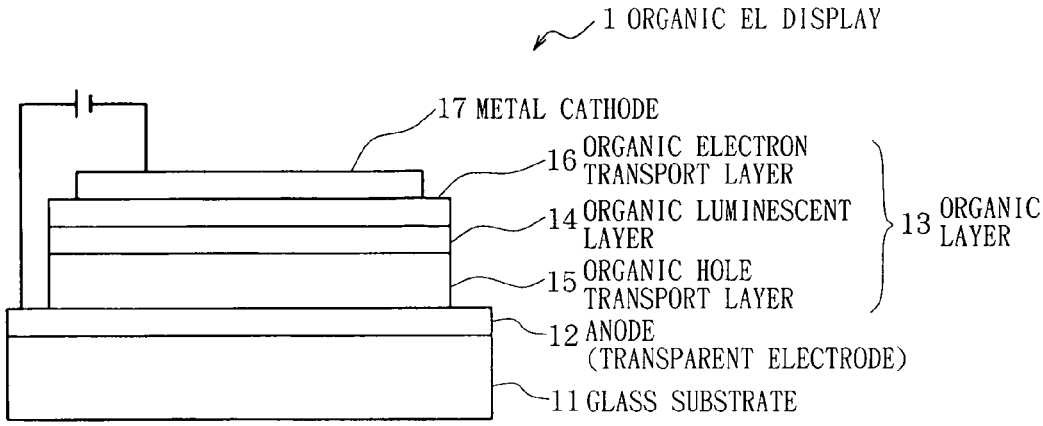
FIG. 33 is a diagram showing the layered structure of an organic LED display of the passive matrix drive type.
Figure 34:
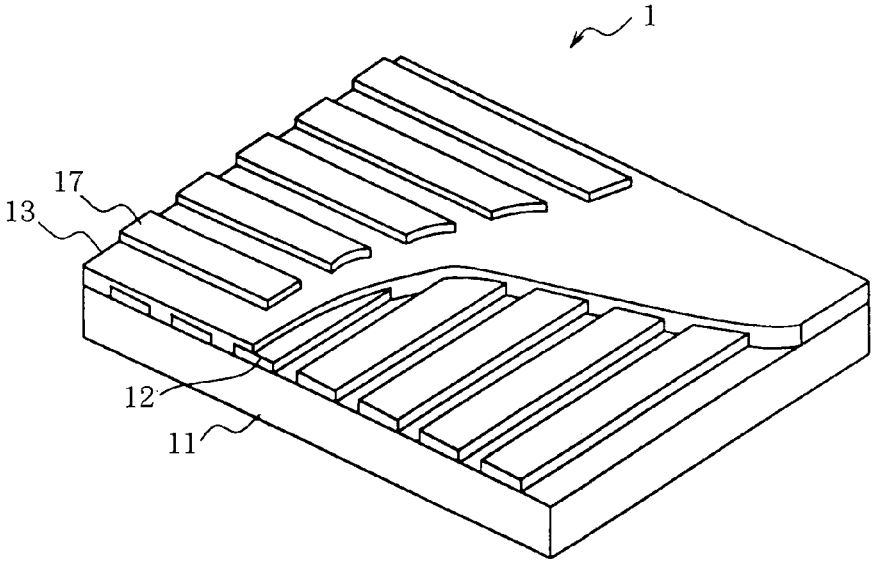
FIG. 34 is a perspective view partly broken away and showing the LED display of the passive matrix drive type.

Further as seen in FIG. 32(*a*), (*b*), the scanning period, as well as the luminescence period, can be made to differ from RGB color to color. This makes it possible to disperse the quantity of current and to alter the ramp voltage from RGB color to color.

Figure 2:
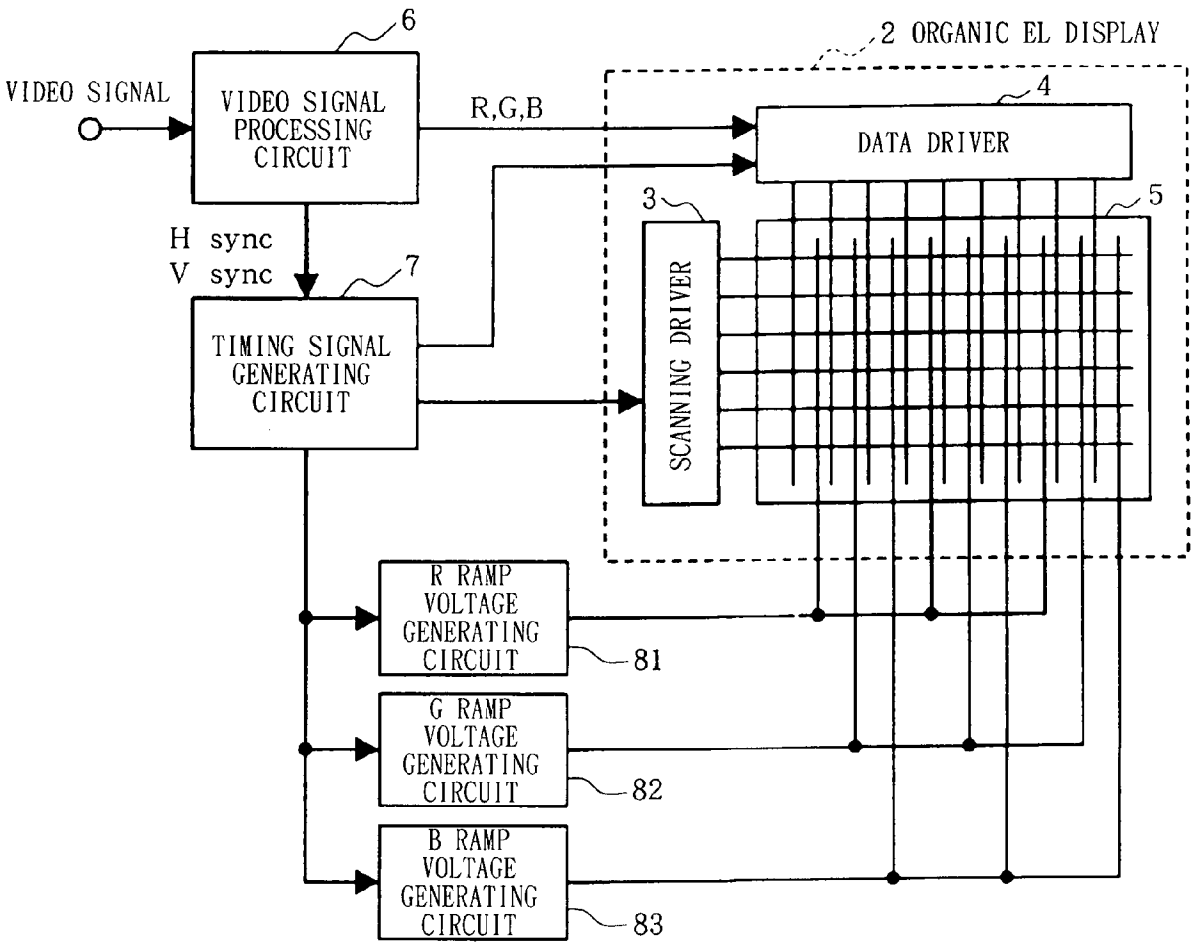
FIG. 2 is a block diagram showing the construction of another organic LED display device embodying the invention.
Figure 9:
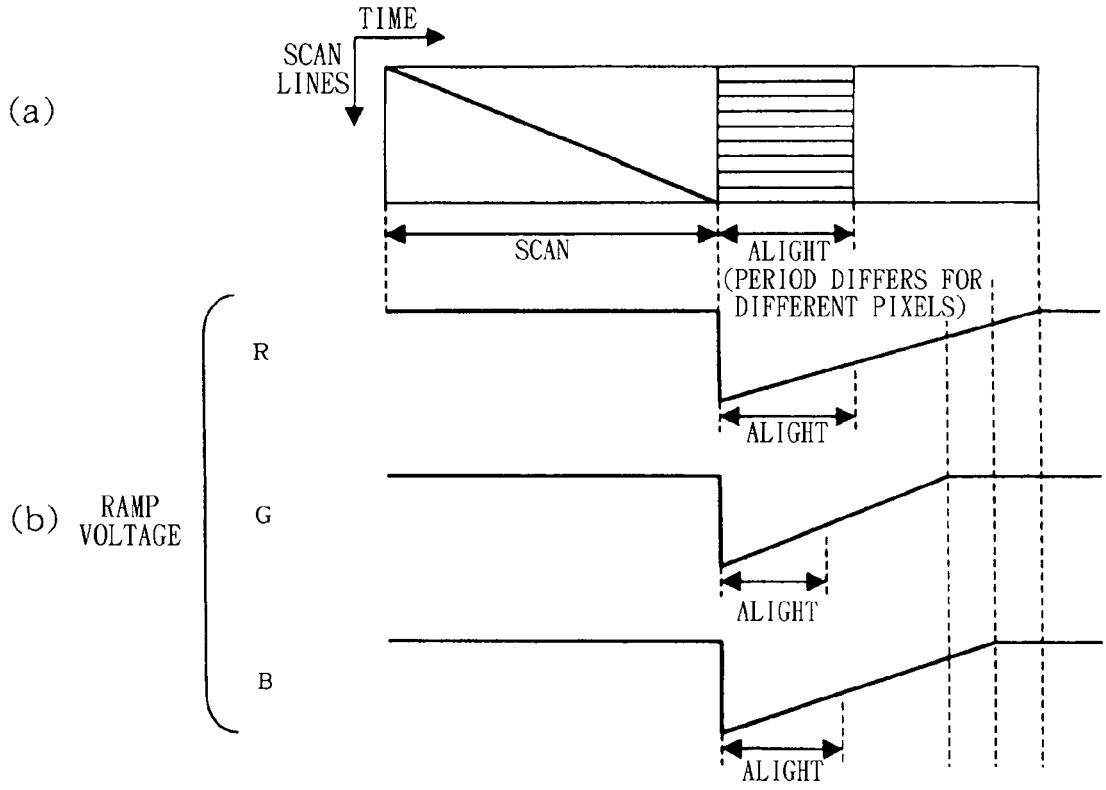
FIG. 9 is a diagram showing the timing of scanning period and luminescence period according to the invention, and other examples of waveforms of ramp voltages according to the invention.

Further as shown in FIG. 9(*a*), (*b*), the variation rate (slope) of the ramp voltage for the pixels arranged on the lines of the three primary colors RGB can be altered from color to color to thereby alter the proportion of the luminescence period from color to color relative to the data voltage. White balance is then adjustable. In this case, an R ramp voltage generating circuit 81, a G ramp voltage generating circuit 82 and a B ramp voltage generating circuit 83 are provided for the respective lines of three primary colors as shown in FIG. 2.

Figure 10:
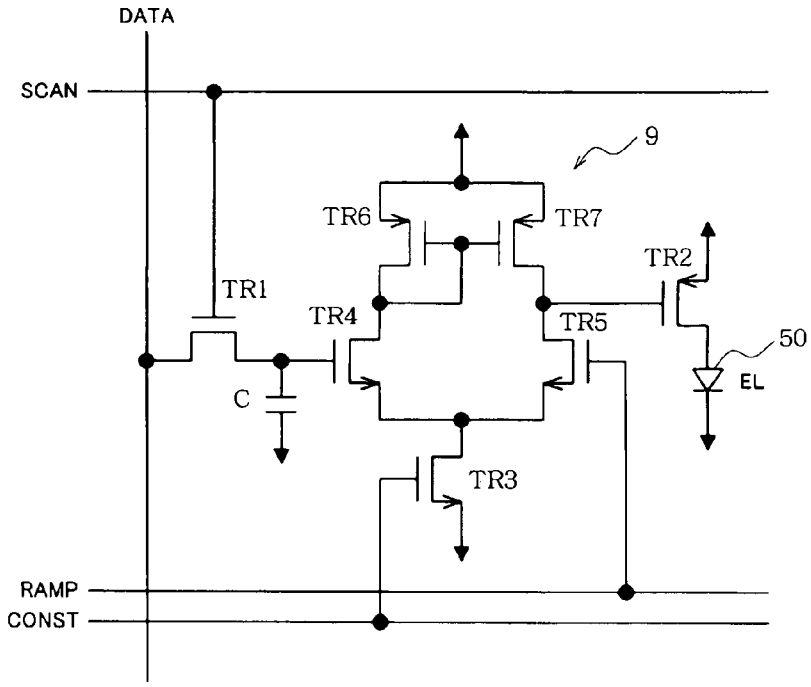
FIG. 10 is a circuit diagram showing the specific construction of a comparator.

FIG. 10 shows the construction of the comparator 9 in detail. As illustrated, the comparator 9 comprises a plurality of transistors TR3 to TR7. A constant voltage is applied to the gate of the transistor TR3 via a constant voltage supply line CONST for this transistor to serve as a constant current source. A capacitor C applies an output voltage (data voltage) to the gate of the transistor TR4. Ramp voltage is applied to the gate of the transistor TR5. The transistors TR6 and TR7 each serve the function of a resistor. When the data voltage is higher than the ramp voltage, current flows through the transistor TR4 for the comparator to deliver a high output, whereas if the ramp voltage is higher than the data voltage, current flows through the transistor TR5, causing the comparator to deliver a low output.

Figure 11:
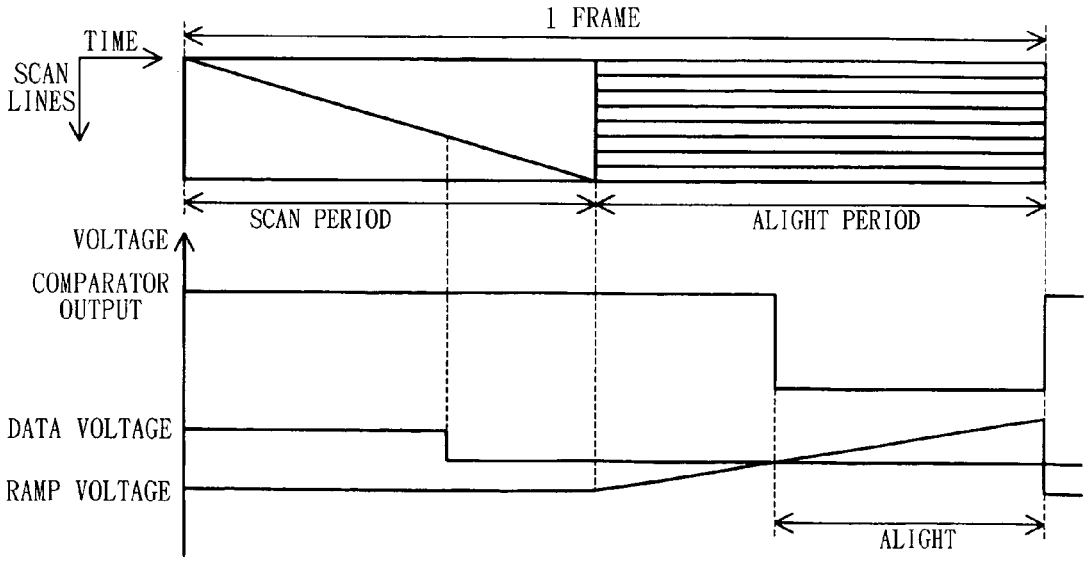
FIG. 11 is a waveform diagram showing the operation of the comparator.

With the comparator 9 described, the data voltage alters within the scanning period as shown in FIG. 11, and the ramp voltage thereafter gradually increases within the luminescence period to exceed the data voltage. This changes the comparator output from high to low to bring the drive transistor TR2 into conduction and pass current through the organic EL element 50.

Figure 12:
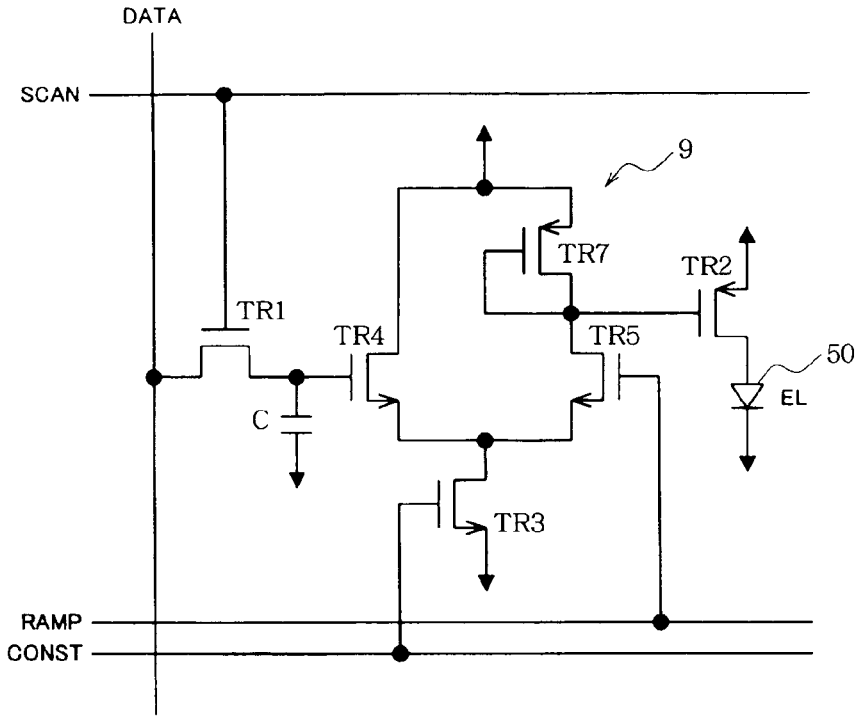
FIG. 12 is a circuit diagram showing the specific construction of another comparator.

FIG. 12 shows a comparator 9, which has the construction shown in FIG. 10 from which one of the resistance components, i.e., transistor TR6, is omitted. Similarly with this comparator 9, the comparator output changes from high to low when the ramp voltage is in excess of the data-voltage, causing the drive transistor TR2 to conduct and passing current through the organic EL element 50.

Figure 13:
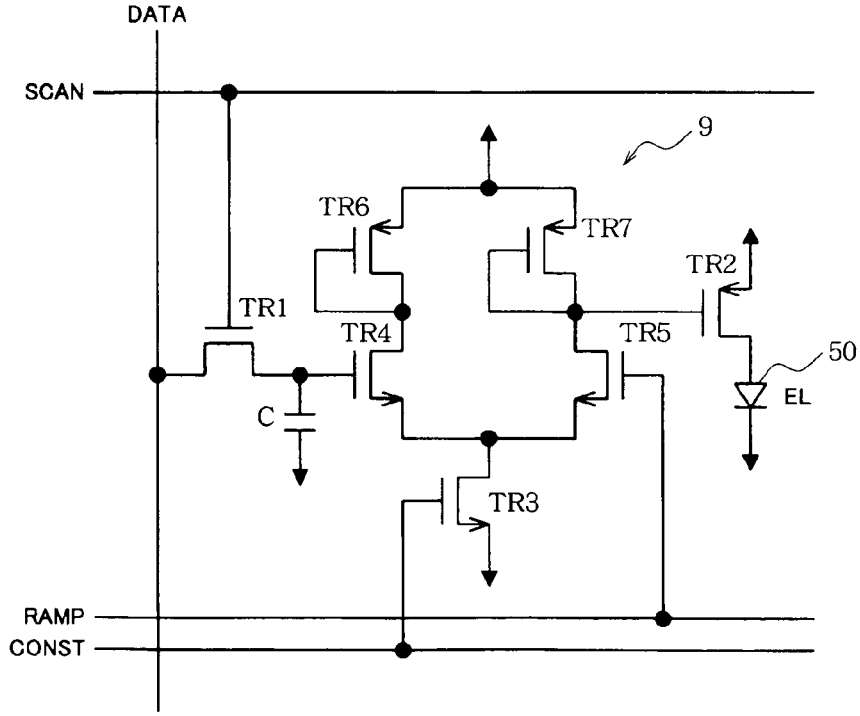
FIG. 13 is a circuit diagram showing the specific construction of another comparator.

FIG. 13 shows another comparator 9, wherein the pair of transistors TR6, TR7 shown in FIG. 10 and serving as resistance components are connected in a different manner as illustrated. This comparator 9 also performs the same function.

Figure 14:
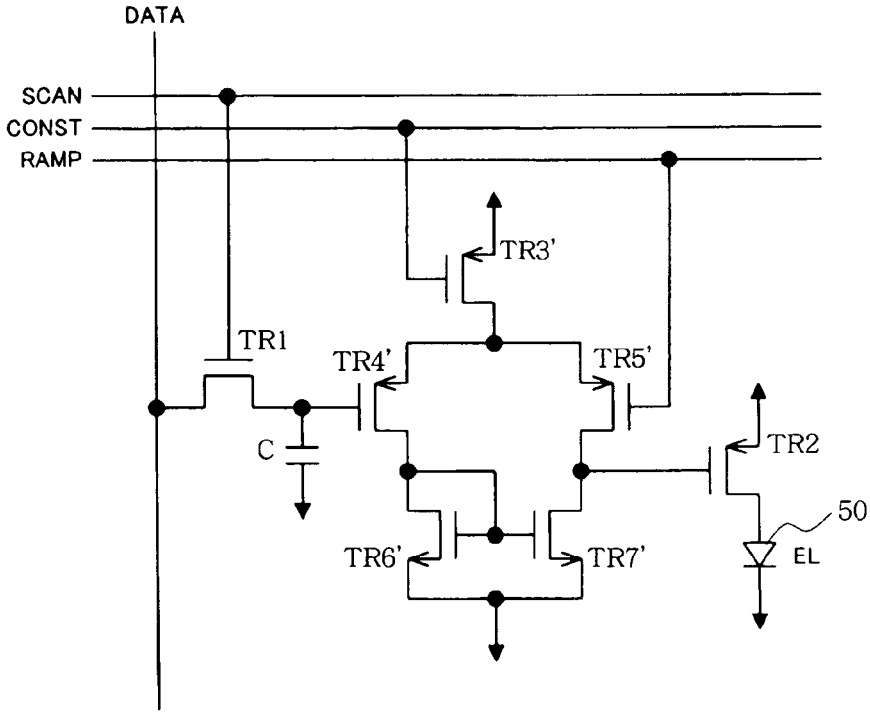
FIG. 14 is a circuit diagram showing the specific construction of another comparator.

FIG. 14 shows another comparator 9, wherein the arrangement shown in FIG. 10 of the transistor TR3 serving as a constant voltage source and the pair of transistors TR6, TR7 serving as resistance components is reversed with respect to the positive-negative relationship. A transistor TR3' serving as a constant current source is provided at the positive side, and transistors TR6', TR7' serving as resistors are arranged at the negative side. In corresponding relationship with this modification, a pair of transistors TR4', TR5' for comparing voltages are of the p-channel type, and the transistors TR6', TR7' serving as resistors are of the n-channel type.

Figure 15:
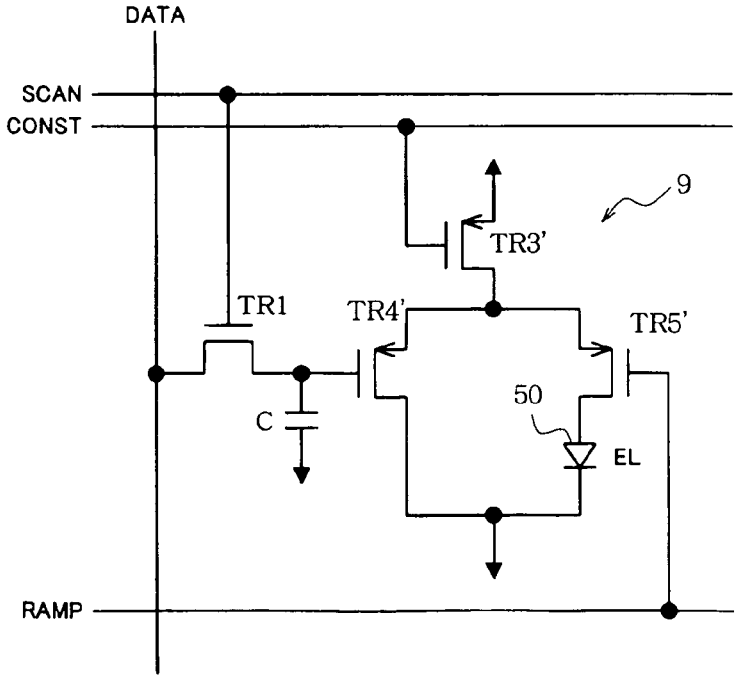
FIG. 15 is a circuit diagram showing the specific construction of another comparator.

FIG. 15 shows a comparator 9, which corresponds to the arrangement shown in FIG. 14 from which the drive transistor TR2 is removed and in which the organic EL element 50 is connected to the drain of the transistor TR5' in the pair of transistors TR4', TR5' so as to on/off-control the flow of current through the EL element 50 by the transistor TR5'.

Figure 16:
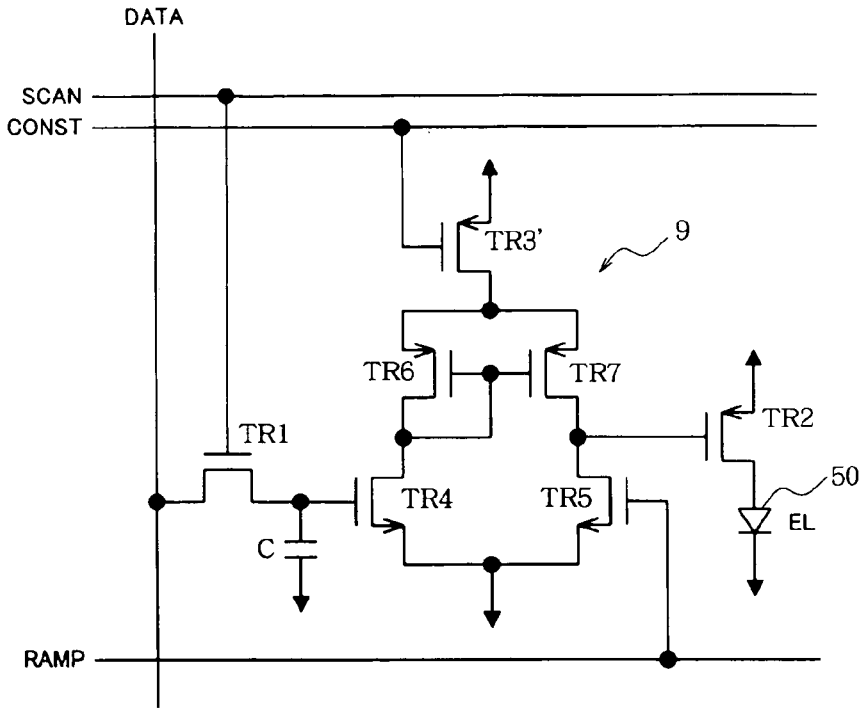
FIG. 16 is a circuit diagram showing the specific construction of another comparator.
Figure 17:
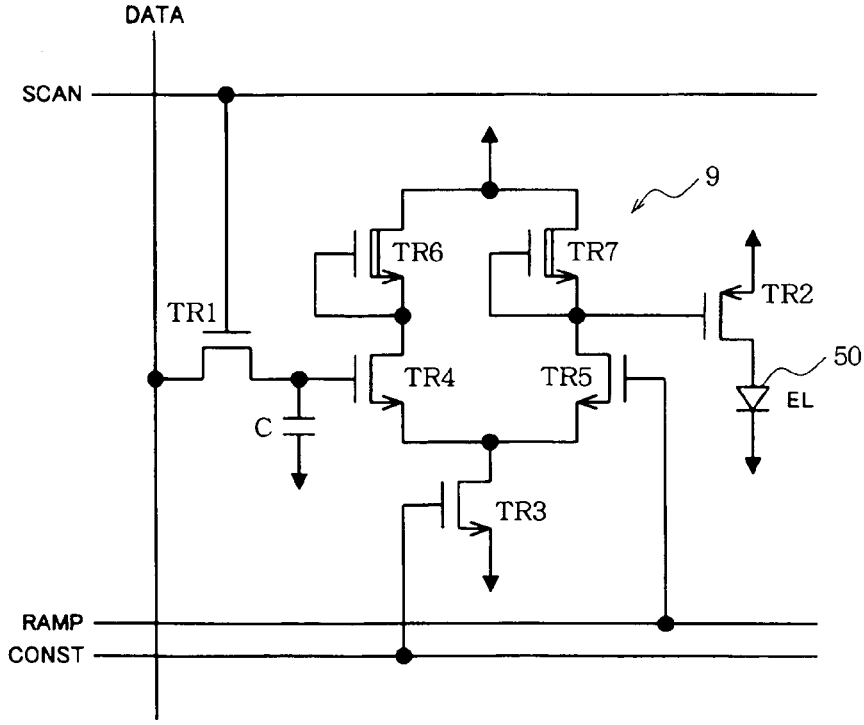
FIG. 17 is a circuit diagram showing the specific construction of another comparator.

FIG. 16 shows a comparator 9, in which the transistor TR3 shown in FIG. 10 and serving as a constant current source is provided at the positive side. With this modification, a transistor TR3' of the p-channel type is used. FIG. 17 shows another comparator 9, wherein transistors of the depletion type are used as the pair of transistors TR6, TR7 serving as resistance components.

Figure 18:
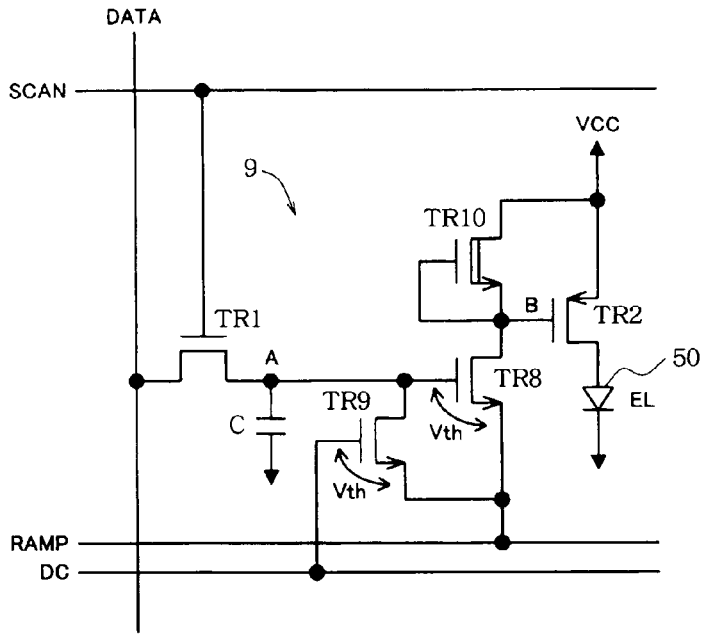
FIG. 18 is a circuit diagram showing the specific construction of another comparator.

FIG. 18 shows a comparator 9, which has transistors TR8, TR9 for effecting or interrupting luminescence, and a transistor TR10 of the depletion type serving as a resistance component. Data voltage is applied to the gate of the transistor TR8 for effecting luminescence, and ramp voltage to the source thereof. A voltage source Vcc is connected via the transistor TR10 to the drain thereof. A constant d.c. voltage DC is applied to the gate of the transistor TR9 for interrupting luminescence, ramp voltage to the source thereof, and data voltage to the drain thereof.

Figure 19:
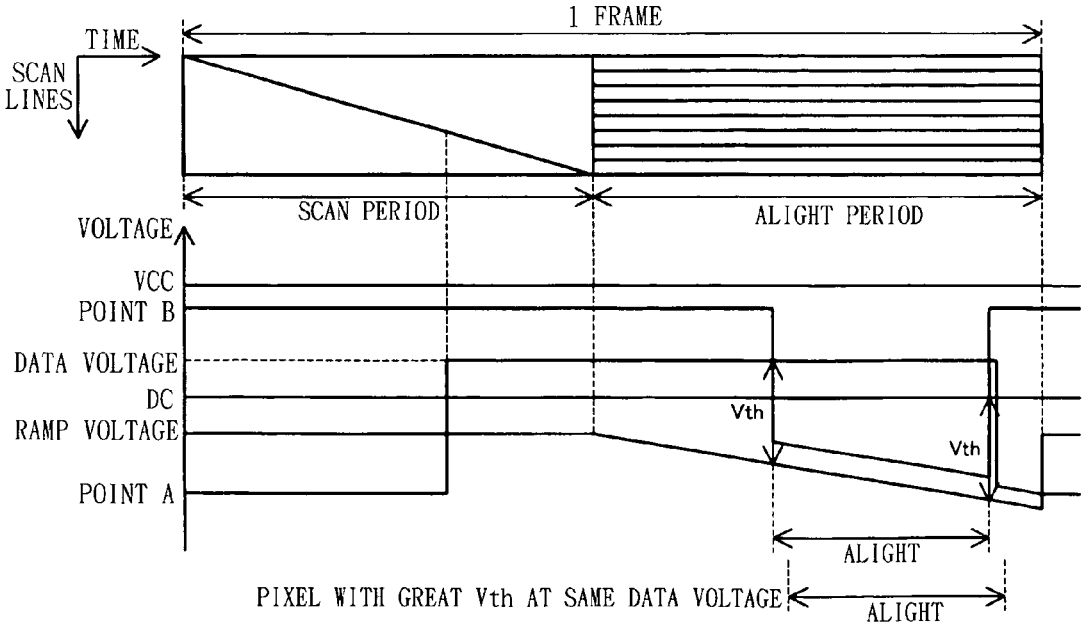
FIG. 19 is a waveform diagram showing the operation of the comparator.

With reference to FIG. 19, the data voltage (voltage at point A) alters during the scanning period, the ramp voltage thereafter drops during the luminescence period, and the difference between these voltages increases. When the difference exceeds a threshold level Vth between the gate of the luminescence effecting transistor TR8 and the source thereof, the transistor TR8 conducts, and the gate voltage (voltage at point B) of the drive transistor TR2 decreases, whereby the transistor TR2 is brought into conduction, passing current through the organic EL element 50 to start luminescence.

The ramp voltage thereafter further decreases to produce an increased difference between the ramp voltage and d.c. voltage DC. When the difference exceeds a threshold level Vth between the gate of the luminescence interrupting transistor TR9 and the source thereof, this transistor TR9 conducts to reduce the gate-source potential difference of the luminescence effecting transistor TR8. This brings the transistor TR8 out of conduction, raising the gate voltage (voltage at point B) of the drive transistor TR2. Consequently, the drive transistor TR2 is turned off to deenergize the organic EL element 50 to complete luminescence.

The luminescence effecting transistor TR8 and the luminescence interrupting transistor TR9 are used in the comparator 9 described, so that even if the gate-source threshold level Vth of these transistors varies from pixel to pixel, the luminescence effecting timing and the luminescence interrupting timing similarly shift as shown in FIG. 19 if the two transistors within the pixel have the same threshold level Vth, hence no variations in the luminescence period.

Figure 20:
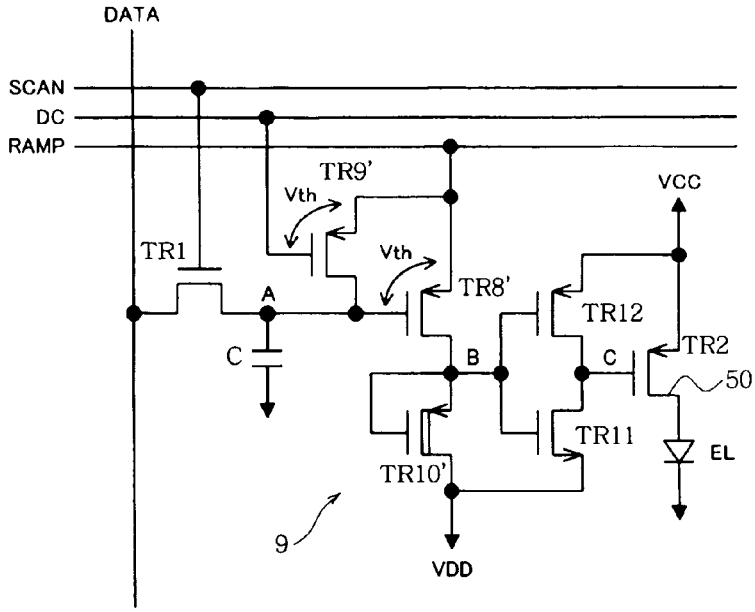
FIG. 20 is a circuit diagram showing the specific construction of another comparator.

FIG. 20 shows another comparator 9, which corresponds to the comparator shown in FIG. 18 wherein a pair of transistors TR11, TR12 for on/off-controlling the gate voltage are provided between point B and the drive transistor TR2. The d.c. voltage DC and ramp voltage are in reversed positive-negative relationship to FIG. 18, and in accordance with this modification, transistors TR8', TR9', TR10' used are of the p-channel type. When the potential at point B exceeds a threshold value, the transistor TR11 for turning on the gate voltage conducts to reduce the potential at point C to zero, while when the potential at point B drops below the threshold value, the transistor TR12 for turning off the gate voltage conducts to change the potential at point C to a high value.

Figure 21:
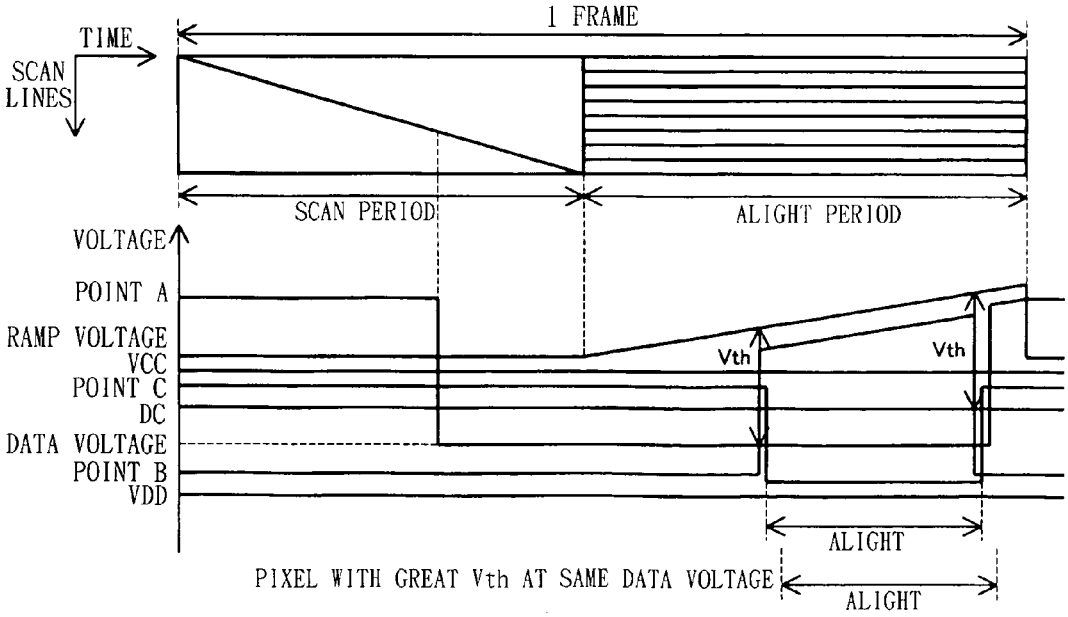
FIG. 21 is a waveform diagram showing the operation of the comparator.

With reference to FIG. 21, the data voltage (voltage at point A) alters during the scanning period, the ramp voltage thereafter rises during the luminescence period, and the difference between these voltages increases. When the difference exceeds a threshold level Vth between the gate of the luminescence effecting transistor TR8' and the source thereof, the transistor TR8' conducts. This raises the voltage at point B, bringing the transistor TR11 for turning on the gate voltage into conduction to decrease the potential at point C to a low value. Consequently, the drive transistor TR2 is brought into conduction, passing current through the organic EL element 50 to start luminescence.

The ramp voltage thereafter further increases to produce an increased difference between the ramp voltage and d.c. voltage DC. When the difference exceeds a threshold level Vth between the gate of the luminescence interrupting transistor TR9' and the source thereof, this transistor TR9' conducts to reduce the gate-source potential difference of the luminescence effecting transistor TR8'. This brings the transistor TR8' out of conduction, reducing the voltage at point B. The transistor TR12 for turning off the gate voltage conducts to give a high potential at point C. Consequently, the drive transistor TR2 is turned off to deenergize the organic EL element 50 to complete luminescence.

The luminescence effecting transistor TR8' and the luminescence interrupting transistor TR9' are used in the comparator 9 described, so that even if the gate-source threshold level Vth of these transistors varies from pixel to pixel, no variations occur in the luminescence period as shown in FIG. 21 provided that the two transistors within the pixel have the same threshold level Vth. Since the gate voltage (voltage at point C) of the drive transistor TR2 is held at a definite value during the luminescence period, the drive transistor TR2 is operable with high reliability.

Figure 22:
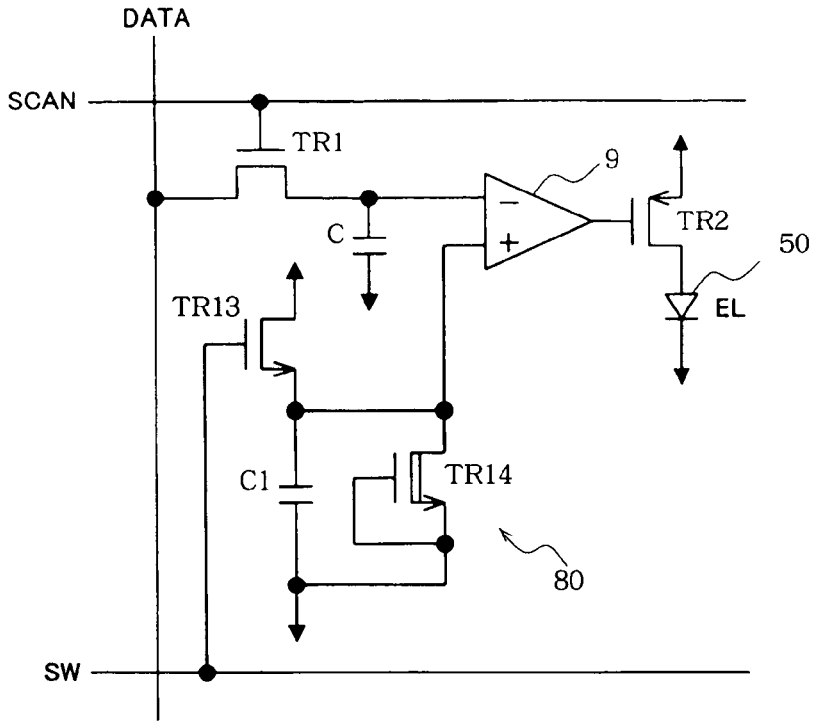
FIG. 22 is a diagram showing the specific construction of a ramp voltage generating circuit incorporated into the pixel.

According to the foregoing embodiments, the ramp voltage is supplied from the ramp voltage generating circuit 8 which is provided externally of the organic LED display 2, whereas the ramp voltage can be generated inside each of the pixels constituting the display 2. For example, FIG. 22 shows a ramp voltage generating circuit 80, which comprises a transistor TR13 to be turned on/off with switching pulses SW, a capacitor C1 chargeable by the conduction of the transistor TR13, and a transistor TR14 of the depletion type performing the function of a discharging resistor. The voltage discharged from the capacitor C1 is applied to the positive terminal of the comparator as the ramp voltage.

Figure 23:
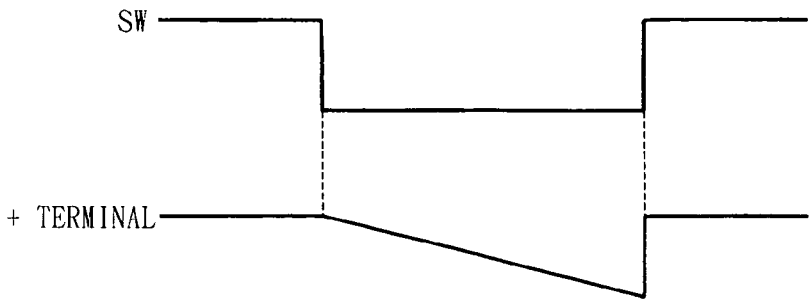
FIG. 23 is a waveform diagram showing the operation of the ramp voltage generating circuit.

With reference to FIG. 23, switching pulses SW change from high to low within the luminescence period. The transistor TR13 conducts while SW is high to charge the capacitor C1, and the transistor TR13 is brought out of conduction while SW is low to discharge the capacitor C1. The voltage of the capacitor C1 gradually drops with discharging, and the voltage to be applied to the positive terminal of the comparator 9 serves as the ramp voltage as shown in FIG. 23.

Figure 24:
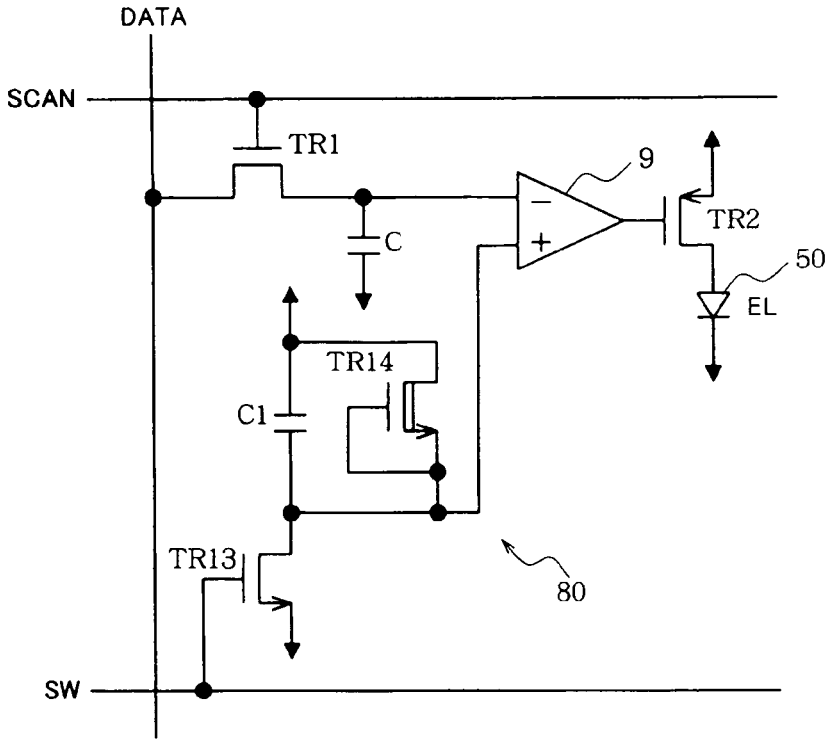
FIG. 24 is a diagram showing the specific construction of another ramp voltage generating circuit incorporated into the pixel.
Figure 25:
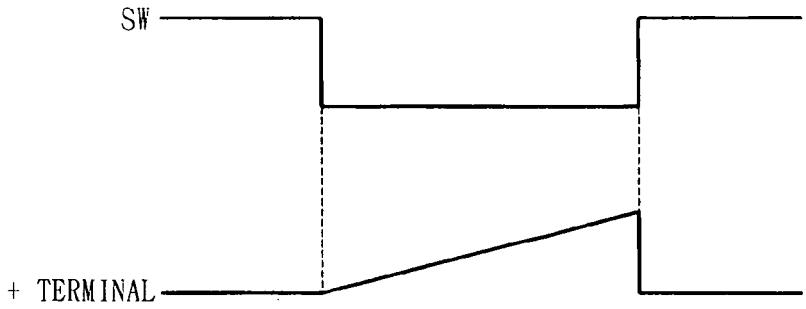
FIG. 25 is a waveform diagram showing the operation of the ramp voltage generating circuit.

FIG. 24 shows a ramp voltage generating circuit 80 wherein the transistor TR13 shown in FIG. 22 is transferred from the positive power source side to the negative power source side. The voltage discharged from a capacitor C1 is applied to the positive terminal of a comparator as the ramp voltage. Switching pulses SW change from high to low during the luminescence period as shown in FIG. 25. While the pulses SW are high, the transistor TR13 conducts to charge the capacitor C1. While SW is low, the transistor TR13 is turned off to discharge the capacitor C1. The voltage of the capacitor C1 gradually drops with discharging, and the voltage to be applied to the positive terminal of the comparator 9 serves as the ramp voltage as shown in FIG. 25.

Figure 26:
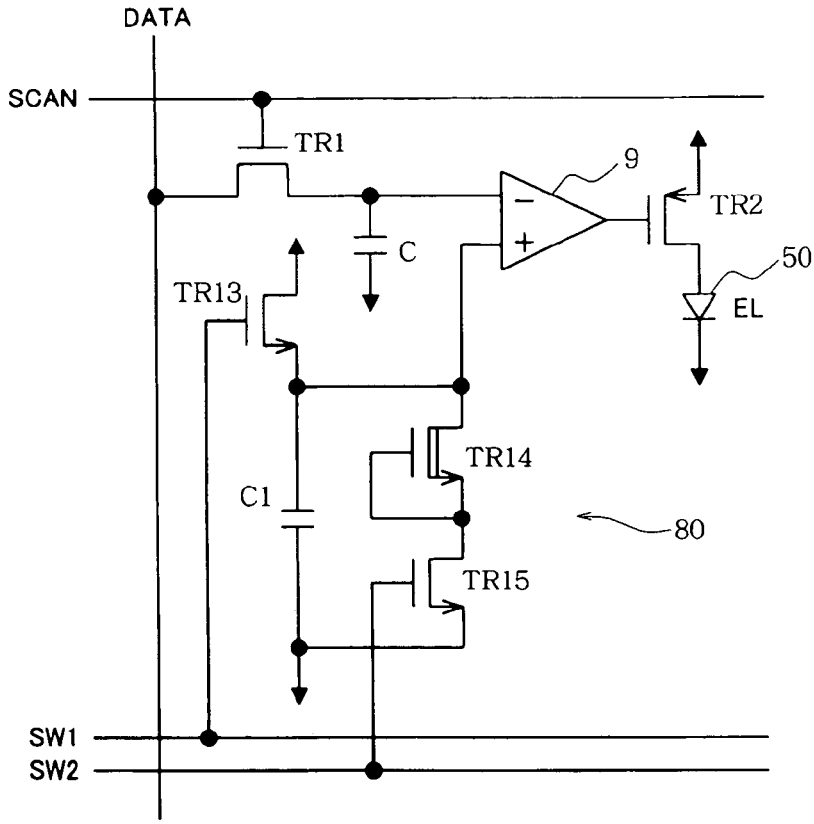
FIG. 26 is a diagram showing the specific construction of another ramp voltage generating circuit incorporated into the pixel.
Figure 27:
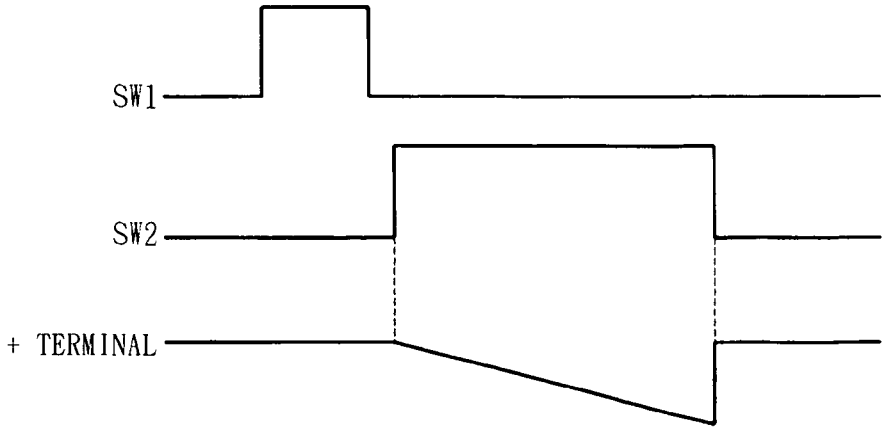
FIG. 27 is a waveform diagram showing the operation of the ramp voltage generating circuit.

FIG. 26 shows a ramp voltage generating circuit 80, which corresponds to the circuit 80 of FIG. 22 wherein a transistor TR15 is connected in series with the transistor TR14 of the depletion type. Second switching pulses SW2 are supplied to the gate of the transistor TR15. First switching pulses SW1 change from low to high during the scanning period as seen in FIG. 27. While SW1 is high, the transistor TR13 conducts to charge the capacitor C1, and while SW1 is low, the transistor TR13 is turned off to discharge the capacitor C1.

Second switching pulses SW2 change from low to high during the luminescence period. While SW2 is low, the transistor TR15 is turned off, preventing current from flowing through the transistor TR14 serving as a resistance element. While SW2 is high, the transistor TR15 conducts, permitting current to flow through the transistor TR14 serving as the resistance element. Thus, no current flows through the transistor TR14 during the scanning period. This results in reduced power consumption.

According to the foregoing embodiments, the ramp voltage is applied to the positive terminal of the comparator 9. However, the luminescence period is controllable by applying a constant voltage to the positive terminal while applying a ramp voltage, altered in level in accordance with the data voltage, to the negative terminal of the comparator 9.

Figure 28:
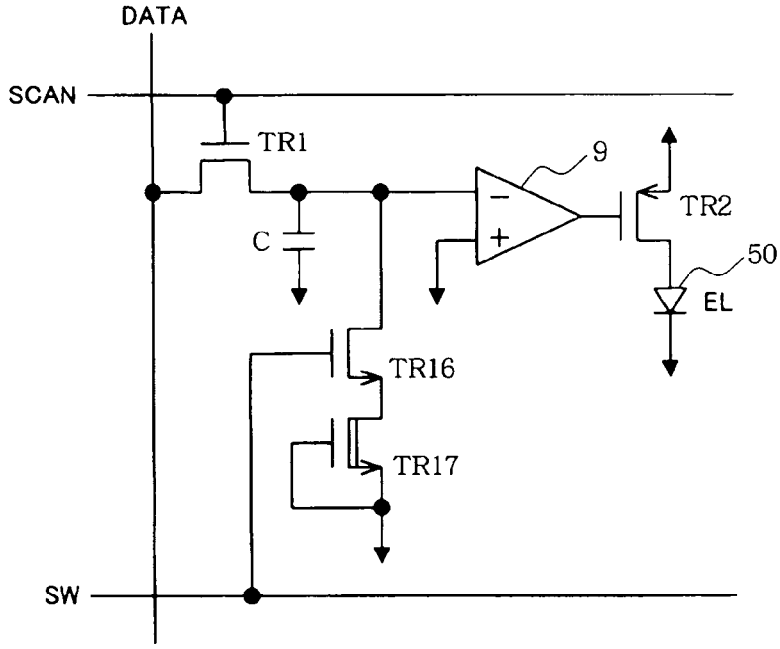
FIG. 28 is a circuit diagram of a pixel wherein the level of ramp voltage is altered according to data voltage.

For example, FIG. 28 shows an arrangement which can be used and in which the output terminal of a capacitor C has connected thereto a transistor TR17 of the depletion type serving as a resistance element, via a transistor TR16 to be on/off-controlled with switching pulses SW. With this arrangement, switching pulses SW are low during the scanning period or high during the luminescence period. While SW is low, the transistor TR16 is out of conduction, permitting charging of the capacitor C. While SW is high, the transistor TR16 conducts, causing the transistor TR17 serving as a resistance element to discharge the capacitor C.

Figure 29:
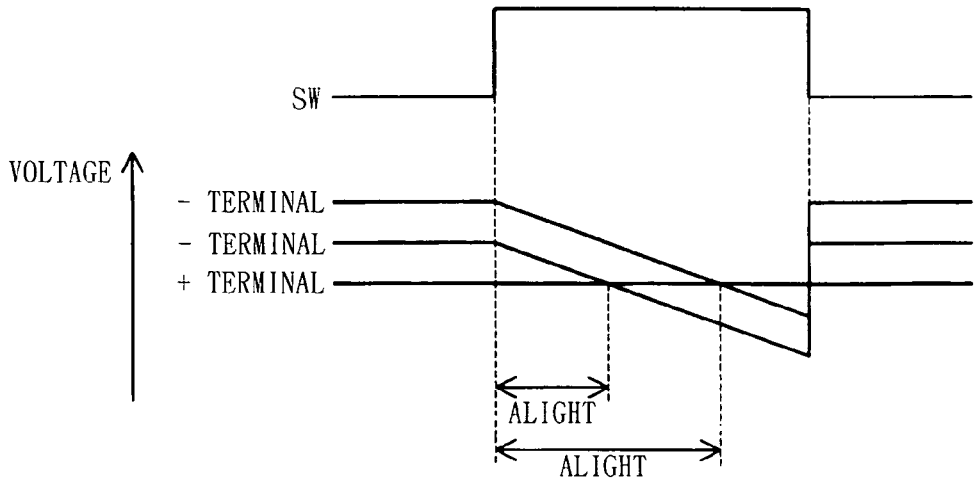
FIG. 29 is a waveform diagram showing the operation of the circuit.

As shown in FIG. 29, therefore, the voltage applied to the negative terminal of the comparator 9 during the scanning period has its level altered in accordance with the data voltage. The data voltage gradually decreases during the discharging process of the capacity C following a change of SW from low to high.

The output of the comparator 9 is low, when the voltage of the negative terminal is in excess of the voltage of the positive terminal, bringing the drive transistor TR2 into conduction to pass current through the organic EL element 50. Subsequently when the voltage of the negative terminal drops below the voltage of the positive terminal, the output of the comparator 9 becomes high to turn off the drive transistor TR2 and block the current to be passed through the EL element 50. As a result, the luminescence period of the EL element 50 varies in corresponding relationship with the magnitude of the data voltage.

In the embodiments of FIGS. 6 and 7, data is written within the first half scanning period, and luminescence is thereafter controlled in the second half luminescence period according to the data, for all the pixels constituting the organic LED display 2. Scanning must therefore be done at a somewhat high speed. Further with the embodiment shown in FIG. 8, the odd-numbered lines and the even-numbered lines are alternately reversed in the order of the scanning period and the luminescence period, so that the scanning speed then decreases, and the embodiment has the drawback that the luminescence period becomes shorter when there is a limitation on the scanning speed.

Figure 30:
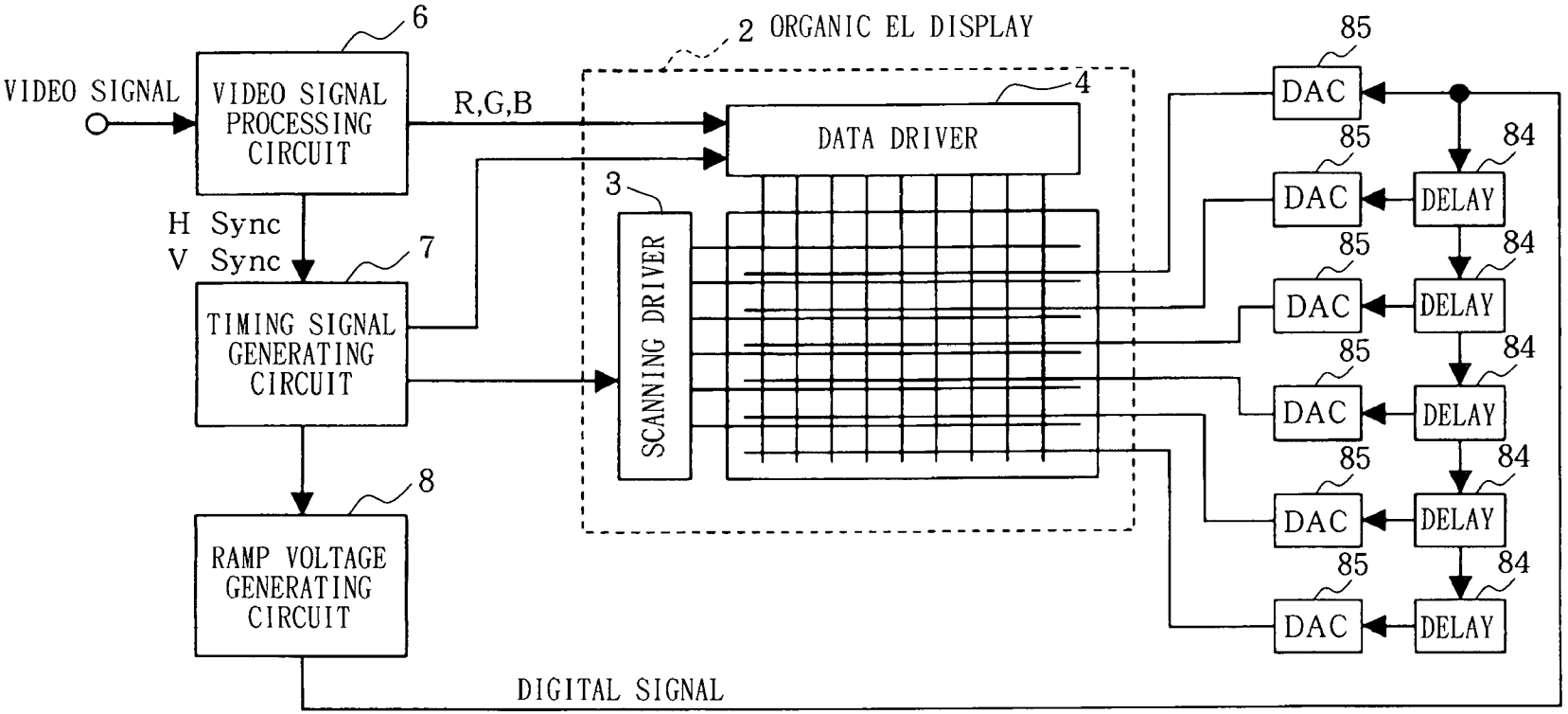
FIG. 30 is a block diagram showing the construction of an organic LED display device wherein the phase of ramp voltage is shifted every horizontal line.
Figure 31:
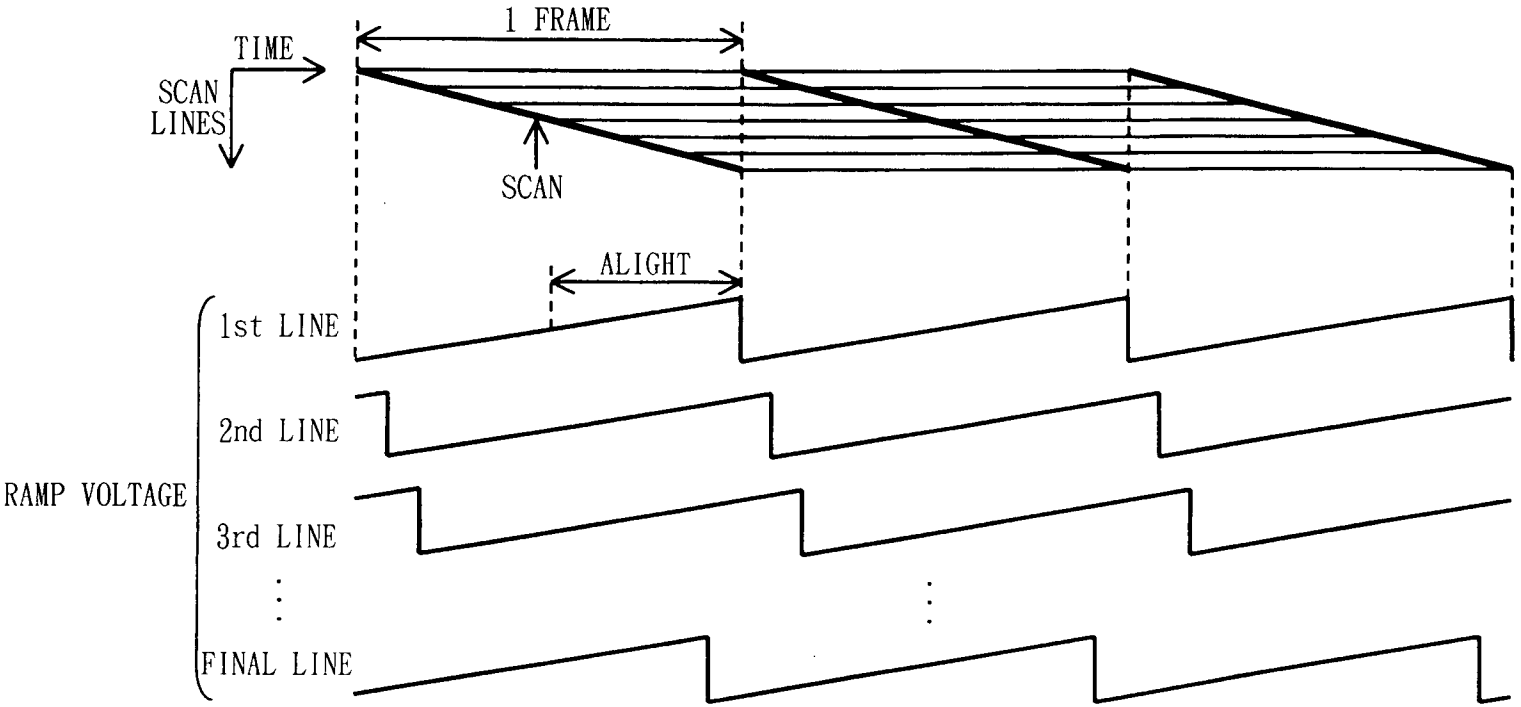
FIG. 31 is a waveform diagram showing the operation of the LED display device.

Accordingly, FIGS. 30 and 31 show an embodiment wherein the ramp voltage is shifted in phase from horizontal line to line so as to effect luminescence of each line immediately after data has been written to the line. The ramp voltage to be delivered from the ramp voltage generating circuit 8 as a digital signal is fed to the pixels of each horizontal line via a delay circuit 84 and DA converter 85, whereby the ramp voltage to be supplied to each horizontal line has its phase shifted by a predetermined time lag for each line, from the first line to the final line as shown in FIG. 31. The data supplied by the data driver 4 is written immediately before the ramp voltage for each horizontal line rises.

Accordingly, the ramp voltage for each horizontal line has a gentle slope, varying from low to high (or from high to low) over one frame period as shown in FIG. 31, and almost the entire frame period can be made to serve as luminescence periods.

Since all the horizontal lines can be scanned using nearly the entire frame period, the scanning speed may be low. Further because the luminescence of pixels is dispersed with respect to time, the influence of voltage drop of the power source line within the display panel can be mitigated.

The device of the present invention is not limited only to the foregoing embodiments in construction but can be modified variously within the technical scope defined in the appended claims. For example, although organic EL elements are used as display elements according to the above embodiments, such elements are not limitative but various other display elements are usable to provide display devices of the invention insofar as these elements luminesce when supplied with current.

In the case where the comparator 9 has satisfactory current drive ability, the drive transistor TR2 can be dispensed with to connect the output terminal of the comparator 9 directly to the organic EL element 50. When the ramp voltage shown in FIG. 6(3) is used, or when the ramp voltage shown in FIG. 6(*c*) is used in this case, the non-inversion input terminal and the inversion input terminal of the comparator 9 need to be reversed for connection. A voltage drive type element is then usable as the display element.

In the comparator shown in FIG. 10, the voltage of the constant voltage supply line CONST can be set at the source potential of the transistor TR3 so as not to pass any current through the comparator 9 during the scanning period. This results in a reduction of power consumption.

The invention claimed is:

1. A display device of the digital drive type comprising a display panel comprising a plurality of pixels arranged in the form of a matrix, and a scanning driver and a data driver which are connected to the display panel, each of the pixels of the display panel comprising:

a display element operable to luminesce when supplied with current or voltage;

a write element to be brought into conduction with scanning voltage applied thereto by the scanning driver;

voltage holding means for holding therein data voltage applied thereto by the data driver by the write element conducting; and drive means for supplying current or voltage to the display element only for a period of time corresponding to the magnitude of the voltage held in the voltage holding means;

wherein the drive means comprises:

a drive element for effecting or interrupting passage of current through the display element in response to the input of an on/off control signal; and a comparison element for comparing ramp voltage having a predetermined variation curve with the output voltage of the voltage holding means and supplying an output signal representing the result of comparison to the drive element as the on/off control signal, wherein one scanning period and one luminescence period are provided within one display cycle of one frame, the scanning voltage is applied to the write element of each pixel by the scanning driver during the scanning period for the voltage holding means of the pixel to hold the data voltage, and the ramp voltage is compared with the output voltage of the voltage holding means by the drive means during the luminescence period to on/off-control the display element of the pixel, the ramp voltage is variable between a first value permitting the output signal of the comparison element to turn on the drive element at all times despite the data voltage and a second value permitting the output signal of the comparison element to turn off the drive element at all times despite the data voltage, and within the display cycle of one frame, retains the second value during the scanning period and varies between the first value and the second value during the luminescence period other than the scanning period, and wherein the ramp voltage for the pixels arranged on odd-numbered lines included in horizontal or vertical lines constituting one frame has a variation curve varying from one of the first value and the second value to the other value, and the ramp voltage for the pixels arranged on even-numbered lines included in the horizontal or vertical lines has a variation curve varying from said other value to said one value.

2. A display device of the digital drive type according to claim 1 wherein the pixels arranged on odd-numbered lines included in horizontal or vertical lines constituting one frame and the pixels arranged on even-numbered lines included in the horizontal or vertical lines are alternately reversed in the order of the scanning period and the luminescence within the display cycle of one frame.

3. A display device of the digital drive type according to claim 1 wherein the ramp voltage for the pixels arranged on lines of three primary colors included in horizontal or vertical lines constituting one frame differs from color to color in the rate of variation between the first value and the second value.

4. A display device of the digital drive type according to claim 1 wherein the drive element comprises a drive transistor for effecting or interrupting passage of current through the display element in responses to the on/off control signal received at a gate thereof, the write element comprising a write transistor to be brought into conduction by the scanning voltage applied to a gate thereof, the voltage holding means comprising a capacitance element for storing therein the data voltage as a charge, the comparison element comprising a comparator for receiving lamp voltage to be supplied from a lamp voltage generating circuit and the output voltage of the capacitance element at a pair of positive and negative input terminals thereof and delivering a high/low signal representing the result of comparison from an output terminal thereof to the gate of the drive transistor.

5. A display device of the digital drive type according to claim 4 wherein the comparator comprises a pair of voltage comparing transistors having respective gates for receiving the ramp voltage to be supplied from the ramp voltage generating circuit and the output voltage of the capacitance element, a current source for supplying current to the voltage comparing transistors, and a resistance element serving as resistance to the current to be passed through the voltage comparing transistors, and has a point where a voltage variation is produced by the passage of current through one of the voltage comparing transistors and which serves as an output terminal.

6. A display device of the digital drive type according to claim 5 wherein one of the voltage comparing transistors serves as the drive transistor for effecting or interrupting passage of current through the display element.

7. A display device of the digital drive type according to claim 6 wherein the ramp voltage generating circuit is provided externally to the display panel.

8. A display device of the digital drive type according to claim 5 wherein the ramp voltage generating circuit is provided externally to the display panel.

9. A display device of the digital drive type according to claim 1 wherein the display element is an organic electroluminescence element.

10. A display device of the digital drive type according to claim 4 wherein the comparator comprises a pair of luminescence effecting/interrupting transistors, the luminescence effecting transistor conducts when the difference between the ramp voltage and the output voltage of the capacitance element exceeds a predetermined threshold value to bring the drive transistor into conduction, and the luminescence interrupting transistor conducts when the difference between the ramp voltage and a predetermined d.c. voltage exceeds a predetermined threshold value to bring the drive transistor out of conduction.

11. A display device of the digital drive type according to claim 10 wherein the ramp voltage generating circuit is provided externally to the display panel.

12. A display device of the digital drive type according to claim 4 wherein the ramp voltage generating circuit is provided externally to the display panel.

13. A display device of the digital drive type according to claim 4 wherein the ramp voltage generating circuit is provided in each pixel of the display panel and supplied with switching pulses from outside the display panel to generate the ramp voltage by charging or discharging of a capacitor during a high or low period of the pulses.

14. A display device of the digital drive type according to claim 13 wherein the ramp voltage generating circuit is provided comprises a transistor for blocking current to be passed with the charging of the capacitor during the scanning period.

15. A display device of the digital drive type comprising a display panel comprising a plurality of pixels arranged in the form of a matrix, and a scanning driver and a data driver which are connected to the display panel, each of the pixels of the display panel comprising:

a display element operable to luminesce when supplied with current or voltage:

a write element to be brought into conduction with scanning voltage applied thereto by the scanning driver;

voltage holding means for holding therein data voltage applied thereto by the data driver by the write element conducting; and drive means for supplying current or voltage to the display element only for a period of time corresponding to the magnitude of the voltage held in the voltage holding means, wherein the drive means comprises:

a drive element for effecting or interrupting passage of current through the display element in response to the input of an on/off control signal; and a comparison element for comparing ramp voltage having a predetermined variation curve with the output voltage of the voltage holding means and supplying an output signal representing the result of comparison to the drive element as the on/off control signal, wherein one scanning period and one luminescence period are provided within one display cycle of one frame, the scanning voltage is applied to the write element of each pixel by the scanning driver during the scanning period for the voltage holding means of the pixel to hold the data voltage, and the ramp voltage is compared with the output voltage of the voltage holding means by the drive means during the luminescence period to on/off-control the display element of the pixel, the ramp voltage is variable between a first value permitting the output signal of the comparison element to turn on the drive element at all times despite the data voltage and a second value permitting the output signal of the comparison element to turn off the drive element at all times despite the data voltage, and within the display cycle of one frame, retains the second value during the scanning period and varies between the first value and the second value during the luminescence period other than the scanning period, and wherein the ramp voltage for the pixels arranged on lines of one of three primary colors included in horizontal or vertical lines constituting one frame has a variation curve varying from one of the first value and the second value to the other value, and the ramp voltage for the pixels arranged on lines provided for the other two colors and included in the horizontal or vertical lines has a variation curve varying from said other value to said one value.

16. A display device of the digital drive type according to claim 15 wherein the pixels arranged on odd-numbered lines included in horizontal or vertical lines constituting one frame and the pixels arranged on even-numbered lines included in the horizontal or vertical lines are alternately reversed in the order of the scanning period and the luminescence within the display cycle of one frame.

17. A display device of the digital drive type according to claim 15 wherein the ramp voltage for the pixels arranged on lines of three primary colors included in horizontal or vertical lines constituting one frame differs from color to color in the rate of variation between the first value and the second value.

18. A display device of the digital drive type according to claim 15 wherein the drive element comprises a drive transistor for effecting or interrupting passage of current through the display element in responses to the on/off control signal received at a gate thereof, the write element comprising a write transistor to be brought into conduction by the scanning voltage applied to a gate thereof, the voltage holding means comprising a capacitance element for storing therein the data voltage as a charge, the comparison element comprising a comparator for receiving lamp voltage to be supplied from a lamp voltage generating circuit and the output voltage of the capacitance element at a pair of positive and negative input terminals thereof and delivering a high/low signal representing the result of comparison from an output terminal thereof to the gate of the drive transistor.

19. A display device of the digital drive type according to claim 18 wherein the comparator comprises a pair of voltage comparing transistors having respective gates for receiving the ramp voltage to be supplied from the ramp voltage generating circuit and the output voltage of the capacitance element, a current source for supplying current to the voltage comparing transistors, and a resistance element serving as resistance to the current to be passed through the voltage comparing transistors, and has a point where a voltage variation is produced by the passage of current through one of the voltage comparing transistors and which serves as an output terminal.

20. A display device of the digital drive type according to claim 19 wherein one of the voltage comparing transistors serves as the drive transistor for effecting or interrupting passage of current through the display element.

21. A display device of the digital drive type according to claim 19 wherein the ramp voltage generating circuit is provided externally to the display panel.

22. A display device of the digital drive type according to claim 20 wherein the ramp voltage generating circuit is provided externally to the display panel.

23. A display device of the digital drive type according to claim 15 wherein the display element is an organic electroluminescence element.

24. A display device of the digital drive type according to claim 18 wherein the ramp voltage generating circuit is provided in each pixel of the display panel and supplied with switching pulses from outside the display panel to generate the ramp voltage by charging or discharging of a capacitor during a high or low period of the pulses.

25. A display device of the digital drive type according to claim 24 wherein the ramp voltage generating circuit is provided comprises a transistor for blocking current to be passed with the charging of the capacitor during the scanning period.

26. A display device of the digital drive type according to claim 18 wherein the ramp voltage generating circuit is provided externally of the display panel.

27. A display device of the digital drive type according to claim 18 wherein the comparator comprises a pair of luminescence effecting/interrupting transistors, the luminescence effecting transistor conducts when the difference between the ramp voltage and the output voltage of the capacitance element exceeds a predetermined threshold value to bring the drive transistor into conduction, and the luminescence interrupting transistor conducts when the difference between the ramp voltage and a predetermined d.c. voltage exceeds a predetermined threshold value to bring the drive transistor out of conduction.

28. A display device of the digital drive type according to claim 27 wherein the ramp voltage generating circuit is provided externally to the display panel.

* * * * *